US012138508B2

(12) United States Patent
Olmanson et al.

(10) Patent No.: US 12,138,508 B2
(45) **Date of Patent: *Nov. 12, 2024**

(54) OROPHARYNGEAL EXERCISE DEVICES, SYSTEMS, AND METHODS

(71) Applicant: REMastered Sleep LLC, Eagan, MN (US)

(72) Inventors: Anders Leif Olmanson, Eagan, MN (US); Bjorn Olmanson, Eagan, MN (US); Gunnar Hodnefield, Grand Rapids, MN (US); Zach Eitel, Plymouth, MN (US); Joseph Evan Molitor, Birchwood, MN (US)

(73) Assignee: REMastered Sleep LLC, Eagan, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/343,021

(22) Filed: Jun. 28, 2023

(65) Prior Publication Data

US 2023/0330481 A1 Oct. 19, 2023

Related U.S. Application Data

(63) Continuation of application No. 17/145,005, filed on Jan. 8, 2021, now Pat. No. 11,724,154.

(60) Provisional application No. 62/958,668, filed on Jan. 8, 2020.

(51) Int. Cl.
*A63B 23/03* (2006.01)

(52) U.S. Cl.
CPC ..... *A63B 23/032* (2013.01); *A63B 2225/62* (2013.01)

(58) Field of Classification Search
CPC .. A47G 19/2266; A47G 21/18; A47G 21/185; A61J 15/00; A63B 21/00058; A63B 21/00076; A63B 21/008; A63B 21/0084; A63B 23/03; A63B 23/032; A63B 23/18; A63B 23/185; A63B 2225/62
See application file for complete search history.

(56) References Cited

U.S. PATENT DOCUMENTS

| | | | |
|---|---|---|---|
| 4,718,662 | A | 1/1988 | North |
| 5,183,057 | A | 2/1993 | Syrop et al. |
| 5,213,553 | A | 5/1993 | Light |
| 5,395,322 | A | 3/1995 | Moser et al. |
| H1557 | H | 7/1996 | Joubert et al. |
| 6,524,225 | B1 | 2/2003 | Arias |
| 7,032,764 | B2 | 4/2006 | Viggiano |
| 7,083,548 | B1 | 8/2006 | Moore et al. |

(Continued)

FOREIGN PATENT DOCUMENTS

| | | | |
|---|---|---|---|
| AU | 2003100795 | A4 | 12/2003 |
| CN | 110352046 | A | 10/2019 |

(Continued)

*Primary Examiner* — Gary D Urbiel Goldner
(74) *Attorney, Agent, or Firm* — Fredrikson & Byron, P.A.

(57) ABSTRACT

The various devices and systems herein include oropharyngeal exercise devices having a pump bulb with a bulb body having a flow restriction structure with a restricted configuration in which the flow restriction structure is configured to restrict the flow of fluid through the lumen such that the user must apply a force to increase the flow of the fluid. Other devices include containers and/or lids thereof with the bulbs attached to or integrated therein.

20 Claims, 16 Drawing Sheets

(56) References Cited

U.S. PATENT DOCUMENTS

| | | | | |
|---|---|---|---|---|
| 7,238,145 | B2 | 7/2007 | Robbins et al. | |
| 7,354,007 | B2 | 4/2008 | Pearson | |
| 8,905,947 | B2 | 12/2014 | Annett et al. | |
| 9,149,681 | B2 | 10/2015 | Smead | |
| 9,757,617 | B2 | 9/2017 | Bell | |
| D827,731 | S | 9/2018 | Hirsch | |
| 10,188,230 | B2 | 1/2019 | Hambrock et al. | |
| 11,724,154 | B2 * | 8/2023 | Olmanson | A63B 23/032 482/11 |
| 2004/0188372 | A1 | 9/2004 | Ruth et al. | |
| 2006/0129127 | A1 | 6/2006 | Ruth et al. | |
| 2006/0226110 | A1 | 10/2006 | Choi et al. | |
| 2010/0127005 | A1 | 5/2010 | Sanbrook et al. | |
| 2010/0181329 | A1 | 7/2010 | Davies et al. | |
| 2010/0222706 | A1 | 9/2010 | Miyahara et al. | |
| 2011/0094520 | A1 | 4/2011 | Mikhailenok et al. | |
| 2011/0130249 | A1 | 6/2011 | Mikhailenok et al. | |
| 2012/0168450 | A1 | 7/2012 | Samson | |
| 2014/0051926 | A1 * | 2/2014 | Oates, II | A61J 7/0053 128/202.16 |
| 2014/0074165 | A1 | 3/2014 | Paxson et al. | |
| 2014/0221917 | A1 | 8/2014 | Oates et al. | |
| 2014/0296915 | A1 | 10/2014 | Finney | |
| 2016/0228741 | A1 | 8/2016 | Noguchi et al. | |
| 2017/0188731 | A1 | 7/2017 | Schuller et al. | |
| 2018/0110682 | A1 | 4/2018 | Tran et al. | |
| 2018/0360692 | A1 | 12/2018 | Sieffert et al. | |
| 2019/0308067 | A1 | 10/2019 | Rohde et al. | |
| 2021/0205656 | A1 * | 7/2021 | Olmanson | A63B 21/008 |

FOREIGN PATENT DOCUMENTS

| | | | | |
|---|---|---|---|---|
| DE | 202006011829 | U1 | 12/2007 | |
| EP | 1222873 | A1 | 7/2002 | |
| EP | 2830548 | B1 | 9/2019 | |
| JP | 2003305095 | A | 10/2003 | |
| JP | 4360688 | B2 | 11/2009 | |
| JP | 2011206093 | A | 10/2011 | |
| JP | 5259966 | B2 | 8/2013 | |
| JP | 2013208357 | A | 10/2013 | |
| JP | 2014054269 | A | 3/2014 | |
| JP | 6333487 | B1 | 5/2018 | |
| JP | 2018068875 | A | 5/2018 | |
| JP | 6494007 | B1 | 4/2019 | |
| WO | WO-0222073 | A1 * | 3/2002 | A47G 19/2272 |
| WO | 2008027820 | A2 | 3/2008 | |
| WO | 2012090507 | A1 | 7/2012 | |
| WO | 2012111269 | A1 | 8/2012 | |
| WO | 2015016890 | A1 | 2/2015 | |
| WO | 2018009422 | A1 | 1/2018 | |
| WO | 2018156729 | A1 | 8/2018 | |

* cited by examiner

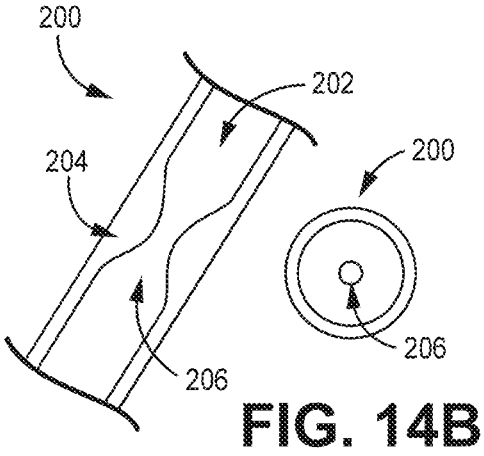
FIG. 14B
FIG. 14A
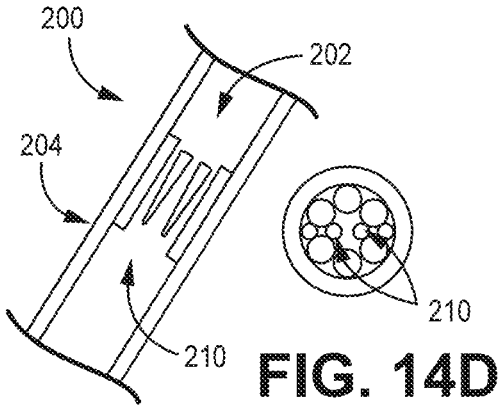
FIG. 14D
FIG. 14C
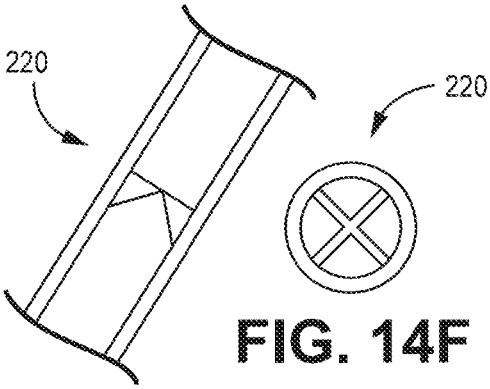
FIG. 14F
FIG. 14E
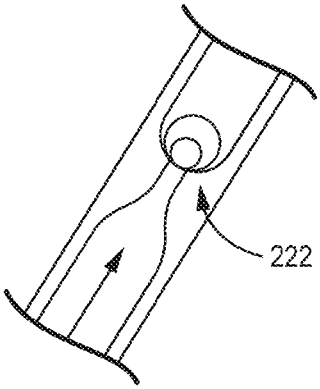
FIG. 15A
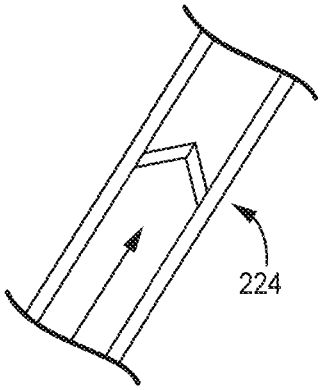
FIG. 15B
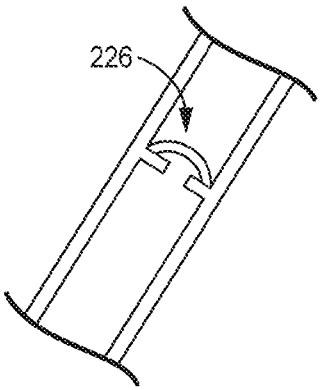
FIG. 15C

OROPHARYNGEAL EXERCISE DEVICES, SYSTEMS, AND METHODS

CROSS-REFERENCE TO RELATED APPLICATION(S)

This application priority as a continuation application to U.S. application Ser. No. 17/145,005, filed Jan. 8, 2021, and entitled "Oropharyngeal Exercise Devices, Systems, and Methods," which claims the benefit under 35 U.S.C. § 119(e) to U.S. Provisional Application 62/958,668, filed Jan. 8, 2020, and entitled "A Convenient Wellness Device to Exercise the Muscles in the Mouth and Throat," both of which are hereby incorporated herein by reference in their entireties.

FIELD

The various embodiments herein relate to methods and systems for treatment of snoring and/or sleep apnea, along with other conditions, and more specifically, to devices and methods for strengthening muscles in the mouth and throat to reduce or eliminate snoring, sleep apnea, and/or other conditions.

BACKGROUND

It is estimated that 44% of males and 28% of females snore habitually in the United States. Snoring is a sound produced by the vibration of the soft tissues of the upper airway during sleep. It can negatively impact the quality of sleep of bedroom partners, resulting in embarrassment or frustration directed towards the snorer or more serious long-term impacts.

Loud and habitual snoring may indicate obstructive sleep apnea (OSA), which can disrupt sleep.

There are over 5.9 million people diagnosed with OSA in the USA, and it is estimated that 80% of people who have OSA do not get diagnosed. OSA is a serious medical condition that affects daytime sleepiness and increases the probability of workplace accidents, comorbidities such as heart disease and diabetes, and chances of death.

Snoring can be caused by multiple contributing factors throughout the upper airway. The nasal cavity can be plugged causing a high-pitched snore. The soft palate can relax and vibrate from air flow. The tongue can relax, fall back, and decrease the airway size, resulting in a louder snore or cessation of breathing. The pharyngeal muscles of the throat can relax and collapse causing the airway to decrease in size and contributing to snoring and/or cessation of breathing.

As a person gains weight there can be buildup of fat tissue in the soft tissues of the tongue, soft palate, and throat. This can cause decreases in airway size and lead to worsening of the snoring and apnea problems. As people age, there is an apparent deterioration of the reflex response of the genioglossus muscle. This muscle of the tongue is used to move the tongue anteriorly during inspiration to counteract the negative pressures generated. OSA is associated with decreased muscle tone of this muscle and others in the mouth and throat.

Most current solutions are based on trying to reduce tissue to increase airway size, avoid things that will relax muscles, mechanically keep the airway open, strengthen muscles, or surgically tighten or remove tissue. There are various disadvantages to each of these solutions.

For example, weight loss can reduce obstructive sleep apnea, but the effort of lifestyle, diet, and exercise changes can be too great of a barrier for patients to begin or maintain over time. Other treatments that are hard to implement into a patient's lifestyle include alcohol and/or tobacco cessation or sleeping in a lateral position.

Another solution is a nasal dilator that can be used to keep the nasal passage mechanically open throughout the night. Similarly, decongestants, saline nasal irrigation, and intranasal glucocorticoids can all work well to keep the nasal passage from being blocked. However, nasal patency only helps one of the factors of snoring and thus will only work for a subset of the population.

Continuous Positive Airway Pressure (CPAP) is the gold standard for obstructive sleep apnea and is also prescribed for snoring. However, the compliance rate is around 40% with 20% of patients outright refusing treatment. The device is uncomfortable, makes a patient feel tethered to a hose while sleeping, has to be cleaned daily, is expensive, and overall is not desirable to patients.

Oral appliances such as those that are used to advance the mandible are another form of treatment for patients. Problems with these devices can include pain in the jaw and long-term side effects such as movement of teeth.

Surgical approaches involve procedures such as uvulopalatopharygoplasty (UPPP), laser assisted UP (LAUP), radiofrequency palate surgery, and palatal implants. However, these procedures are considered quite painful, they seem to only have short term effects, and most people would not recommend them to other people.

Yet another solution involves strengthening the muscles in the mouth and throat through oropharyngeal exercises.

One disadvantage of these exercise regiments is the burden on the patient (including attending therapy sessions, practicing at home, and performing the therapy correctly on her own). In addition, people do not like to admit something is wrong with them.

One specific approach for such exercise is playing the digeridoo. However, disadvantages include having to learn how to play the instrument and the time required to learn and then play the instrument.

A further known solution is an app-based snoring exercise therapy. However, the downside of this solution is that it takes 15 minutes out of a person's day, it wouldn't be used in public because the user must make vocalizations, and it may be considered repetitive after 1 week of use for some people.

There is a need in the art for improved methods, systems, and devices for treating snoring and/or sleep apnea.

BRIEF SUMMARY

Discussed herein are various exercise devices for use by a user to perform various oropharyngeal exercises, including various pump bulb embodiments and container embodiments that operate in combination with a pump bulb.

In Example 1, an oropharyngeal exercise device comprises a bulb body comprising a mouthpiece sized and shaped to be insertable into a user's mouth, a proximal extension, and a central body disposed between the mouthpiece and the proximal extension. The device further comprises a lumen defined within the bulb body such that the lumen is defined within the mouthpiece, the proximal extension and the central body, a proximal opening defined in the proximal extension, wherein the proximal opening is sized to couple with an elongate tube, whereby the proximal opening allows liquid to flow into the lumen, a flow restriction structure associated with the bulb body, wherein the flow restriction structure comprises a restricted configuration in which the flow restriction structure is configured to restrict the flow of fluid through the lumen such that the user must apply at least a first amount of negative pressure to increase the flow of the fluid, and at least one distal opening defined in the mouthpiece and in fluidic communication with the lumen, wherein the flow restriction structure can be the at least one distal opening.

Example 2 relates to the exercise device according to Example 1, wherein the mouthpiece has an ovular cross-sectional shape.

Example 3 relates to the exercise device according to Example 1, wherein the flow restriction structure further comprises an unrestricted configuration configured to allow liquid to flow therethrough at a rate greater than the restricted configuration. wherein the flow restriction structure is urged into the unrestricted configuration after the user has applied at least a second amount of negative pressure, wherein the second amount is greater than the first amount.

Example 4 relates to the exercise device according to Example 1, wherein the at least one distal opening is a slit defined in a distal end of the distal extension.

Example 5 relates to the exercise device according to Example 4, wherein a length of the slit is substantially parallel with a cross-sectional width of the distal extension.

Example 6 relates to the exercise device according to Example 4, wherein the slit comprises stress relief openings defined at each end of the slit.

Example 7 relates to the exercise device according to Example 1, wherein the central body has an outer diameter that is greater than an outer diameter of the distal extension and the proximal extension.

Example 8 relates to the exercise device according to Example 1, wherein the central body has an outer diameter that is less than an outer diameter of the distal extension and the proximal extension.

Example 9 relates to the exercise device according to Example 1, wherein the central body has an outer diameter that is substantially similar to an outer diameter of the distal extension and the proximal extension.

Example 10 relates to the exercise device according to Example 1, wherein the flow restriction structure is disposed anywhere along a length of the lumen.

Example 11 relates to the exercise device according to Example 10, wherein the flow restriction structure comprises a narrow section defined within the lumen, wherein the narrow section has a narrower diameter than any other portion of the lumen.

In Example 12, an oropharyngeal exercise system comprises a liquid container, a lid removably coupleable to the liquid container, the lid comprising a bulb-receiving opening defined in the lid, and a pump bulb removably positionable in the bulb-receiving opening. The pump bulb comprises a bulb body comprising a mouthpiece, a proximal extension, and a central body disposed between the mouthpiece and the proximal extension, wherein the central body has an outer diameter that is greater than an outer diameter of the mouthpiece and the proximal extension. In addition, the pump bulb further comprises a lumen defined within the bulb body, at least one distal opening defined in the distal extension and in fluidic communication with the lumen, wherein the opening is configured to restrict flow of a liquid out of the lumen, and a proximal opening defined in the proximal extension, wherein the proximal opening is larger than the at least one distal opening, whereby the proximal opening allows liquid to flow into the lumen.

Example 13 relates to the exercise system according to Example 12, wherein the central body comprises an attachment structure, wherein the attachment structure is configured to sealably couple with the bulb-receiving opening.

Example 14 relates to the exercise system according to Example 12, further comprising an elongate tube removably positionable within the proximal opening.

Example 15 relates to the exercise system according to Example 12, wherein the at least one distal opening is a slit defined in a distal end of the mouthpiece.

In Example 16, an oropharyngeal exercise device comprises a bulb body comprising a distal extension, a proximal extension, and a central body disposed between the distal extension and the proximal extension. The device further comprises a lumen defined within the bulb body such that the lumen is defined within the distal extension, the proximal extension and the central body, and at least one distal opening defined in the distal extension and in fluidic communication with the lumen. The at least one distal opening comprises a first, restricted configuration configured to restrict flow of liquid therethrough, and a second, open configuration configured to allow liquid to flow therethrough at a rate greater than the first, restricted configuration, wherein the at least one distal opening is urged into the second, open configuration when the user has applied a predetermined amount of compressive force to external walls of the distal extension via a tongue of the user. Further, the device also comprises a proximal opening defined in the proximal extension, wherein the proximal opening is larger than the at least one distal opening, whereby the proximal opening allows liquid to flow into the lumen.

Example 17 relates to the exercise device according to Example 16, wherein the distal extension has an ovular cross-sectional shape.

Example 18 relates to the exercise device according to Example 16, wherein the distal extension is a mouthpiece configured for insertion into a user's mouth.

Example 19 relates to the exercise device according to Example 16, wherein the at least one distal opening is defined in a distal end of the distal extension.

Example 20 relates to the exercise device according to Example 16, wherein the at least one distal opening comprises a plurality of distal openings.

While multiple embodiments are disclosed, still other embodiments will become apparent to those skilled in the art from the following detailed description, which shows and describes illustrative embodiments. As will be realized, the various implementations are capable of modifications in various obvious aspects, all without departing from the spirit and scope thereof. Accordingly, the drawings and detailed description are to be regarded as illustrative in nature and not restrictive.

BRIEF DESCRIPTION OF THE DRAWINGS

FIGS. 14A, 14C, 14E, 15A, 15B, and 15C depict cross-sectional side views of various flow restriction sections, according to certain embodiments.

FIGS. 14B, 14D, and 14F depict cross-sectional top views of the flow restriction sections of FIGS. 14A, 14C, and 14E, respectively, according to certain embodiments.

DETAILED DESCRIPTION

The various device and method embodiments disclosed herein promote and guide oropharyngeal exercises to strengthen muscles in the mouth and throat by providing a standardized set of exercises and therapy ranges that may be incorporated into one's daily drinking/eating routine, thereby addressing the burden of learning, practicing, and improving upper airway exercises.

The device, according to one embodiment, includes a liquid delivery mechanism that requires the user to perform repeated exercises in order to urge the liquid out of the mechanism such that the user can drink it. The device can cause the user to use specific motions to deliver the water, thereby strengthening the various muscles in the mouth (including, for example, tongue, soft palate, and/or pharyngeal dilator muscles) while also providing repetitions, a duration to hold, and/or resistance to enhance the effect.

The various implementations disclosed or contemplated herein work to blend therapy with a normal daily routine so the patient no longer has the need to create a separate workout routine, it takes little to no time out of her day for therapy, and/or she does not have to mentally focus on the therapy. This makes the therapy almost burden-less for the patient and creates a therapy that the patient does not have to think about or even be consciously aware is therapy.

According to certain embodiments, the device can be discrete so the patient can bring the device with them, can practice the therapy whenever they want, and/or not have to worry about using the device/practicing the therapy in public. This changes how the exercise routine can be administered to the patient and gives the option for low intensity and high frequency/duration exercises that may be practiced throughout the day.

The various implementations of the device as disclosed or contemplated herein may also promote proper hydration, which can have beneficial effects. The device therapy mechanism according to various embodiments may be intuitive to use and may guide proper exercise techniques.

Figure 1A:
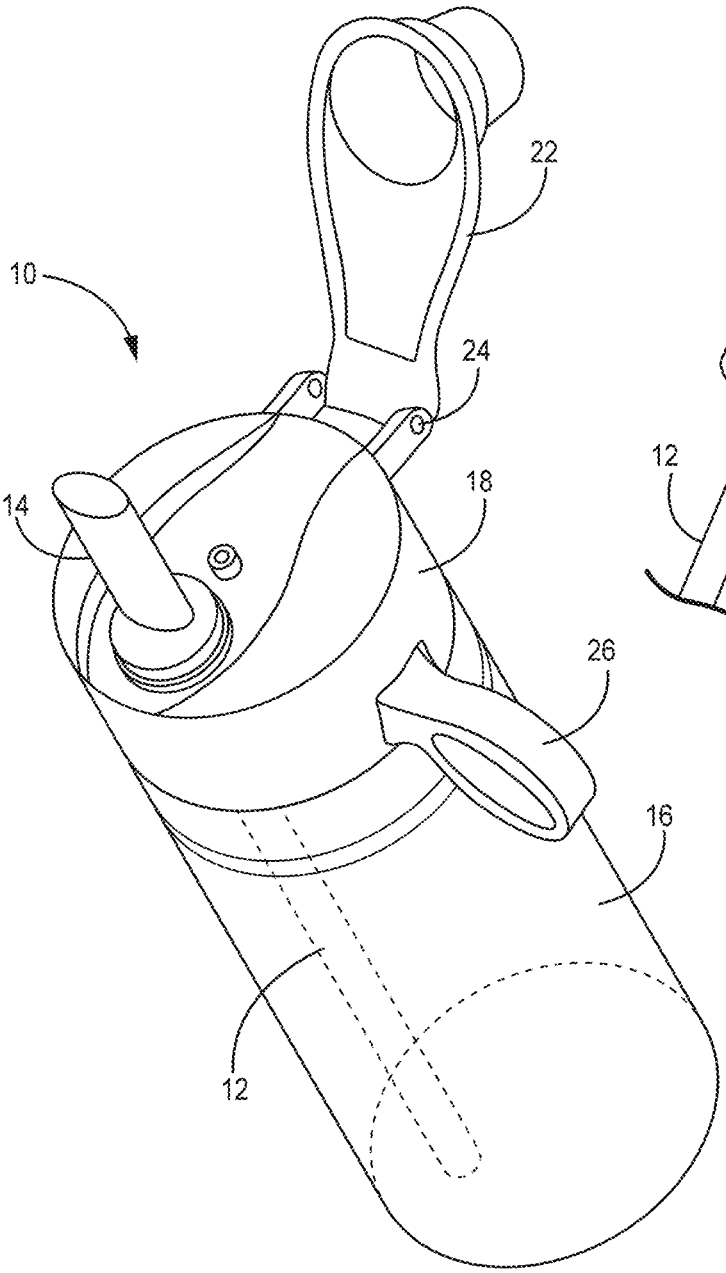
FIG. 1A is a perspective view of an exercise device that includes a liquid container and a pump bulb, according to one embodiment.
Figure 1B:
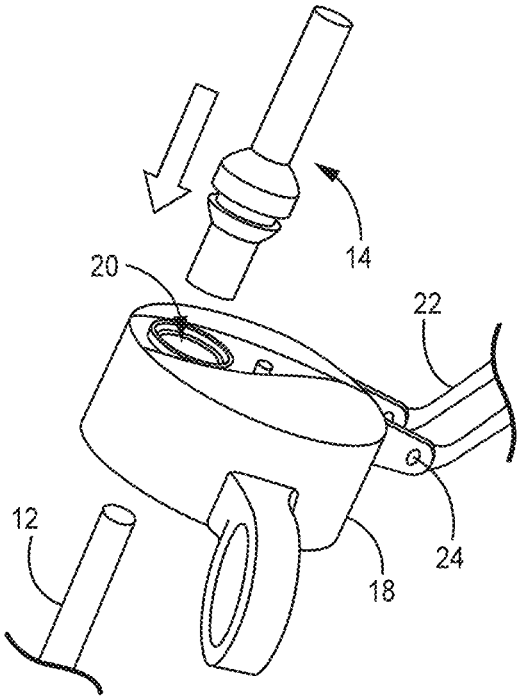
FIG. 1B is an exploded perspective view of the lid and bulb of the exercise device of FIG. 1A, according to one embodiment.
Figure 1C:
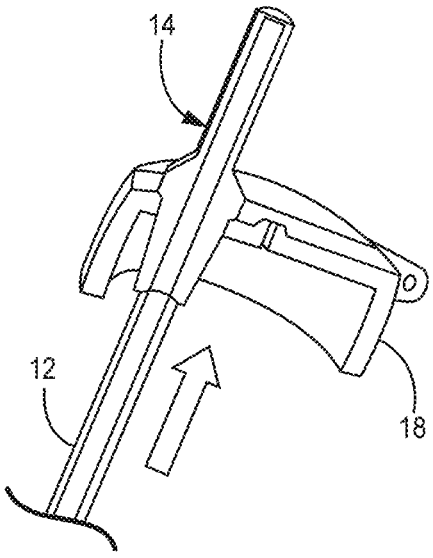
FIG. 1C is a cross-sectional perspective view of the lid and bulb of the exercise device of FIG. 1A, according to one embodiment.

One exemplary embodiment of an oropharyngeal exercise device 10 is depicted in FIGS. 1A-1C, in which the device 10 is a liquid container (such as a bottle or other type of container) 10 having an elongate tube (or "straw") 12 with a pump bulb (also referred to as a "mouth bulb," "pump nozzle," and "mouth nozzle") 14 disposed at the distal end as shown. In this specific implementation, the container 10 has a container body 16 and a detachable lid 18 with an opening 20 defined therein such that the elongate tube 12 and bulb 14 can be disposed through the opening 20. As such, the tube 12 extends into the interior of the body 16 such that the proximal end of the tube 12 is disposed at or near the bottom of the container body 16 as shown. Further, the pump bulb 14 extends from the lid 18 such that a user can insert the bulb 14 into the user's mouth to perform the desired exercises in order to urge water from the container body 16 through the tube 12 and bulb 14 and into the user's mouth. Such a liquid container device 10 with a pump bulb 14 can make therapy discrete, portable, and/or part of daily routine.

According to certain embodiments, the detachable lid 18 can have a removable protective cover 22 that can be removably disposed over the bulb 14 in order to protect the bulb 14 when the device 10 is not in use. In the specific implementation depicted, the cover 22 is rotatably attached to the lid 18 at a joint such that the cover 22 is attached to the lid 18 and can rotatably move between a covered position (not shown) and an open position (as shown in FIGS. 1A-1C). Alternatively, the removable cover 22 can be attached to the lid 18 via any known mechanism.

Further, the lid 18 can also have a handle 26 attached thereto that can be used by a user to carry the device 10 or to attach the lid 18 to another object. In this embodiment, the handle 26 is a ring 26. Alternatively, the handle 26 can take any known form for grasping onto the device 10 or to attach the device 10 to another object.

The lid 18 can be removably coupled to the container body 16 via any known attachment mechanism, including, for example, threads, a snap-on mechanism, etc.

In certain alternative embodiments, the lid 18 need not be a detachable lid 18 as described above. Instead, the structure to which the pump bulb 14 attaches can be a permanent lid or cover or top portion on a disposable container. Alternatively, the structure can be another structure on a container, such as a side wall of the container. As such, the bulb 14 can be coupled with an opening on any known structure of any known type of container.

In one implementation, the pump bulb 14 of the device 10 is depicted in additional detail in FIGS. 2A-3C. Alternatively, it is understood that the pump bulb 14 incorporated into device 10 can be any bulb embodiment disclosed or contemplated herein, including, but not limited to, the embodiments of FIGS. 6, 8, 10A-13F, 18, and 20.

The pump bulb 14 as shown in FIGS. 2A-3C can not only be used in the device 10 as described above and depicted in FIGS. 1A-1C, but also any other device embodiment disclosed or contemplated herein. As best shown in FIGS. 2A-2D and 3A and 3B, the bulb 14 has a body 40 with a distal extension (also referred to as a "mouthpiece") 42, a proximal extension 44, and central body (also referred to as a "connector" or "attachment collar") 46 disposed between the distal and proximal extensions 42, 44. In this embodiment, the central body 46 is an attachment collar 46 that has a groove (or channel) 48 defined within the collar 46 such that the groove 48 can be used to removably attach the bulb 14 to a container device (such as device 10 described above) or any other device into which the bulb 14 is to be incorporated or to which the bulb 14 is to be attached. Alternatively, any known attachment feature or mechanism can be used or incorporated in place of the attachment collar 46. As best shown in FIGS. 3A and 3B, the body 40 defines an interior cavity (or "lumen") 50 within the mouthpiece 42, the attachment collar 46, and the proximal extension 44 such that the lumen 50 extends along the length of the body 40.

Figure 2A:
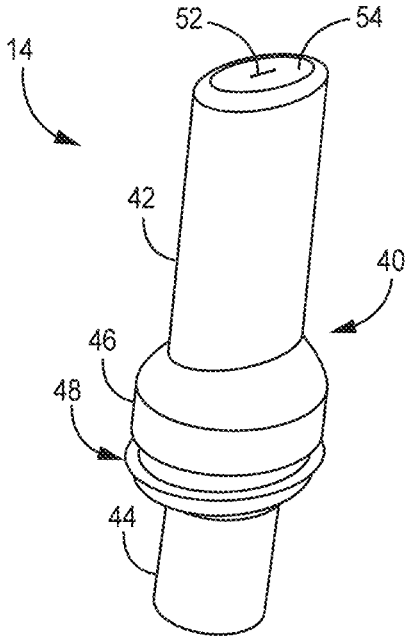
FIG. 2A is a perspective view of a pump bulb, according to another embodiment.
Figure 2B:
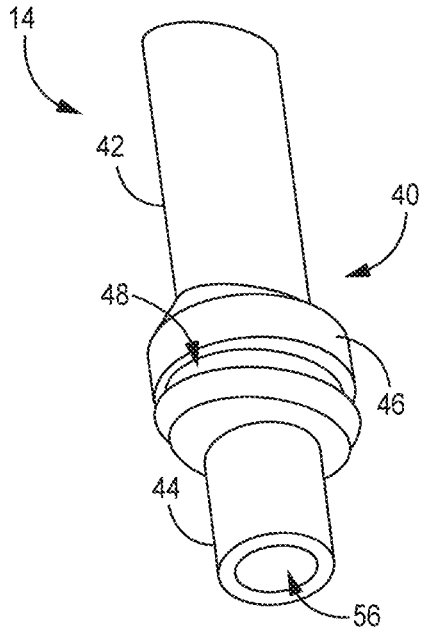
FIG. 2B is another perspective view of the pump bulb of FIG. 2A, according to one embodiment.
Figure 2C:
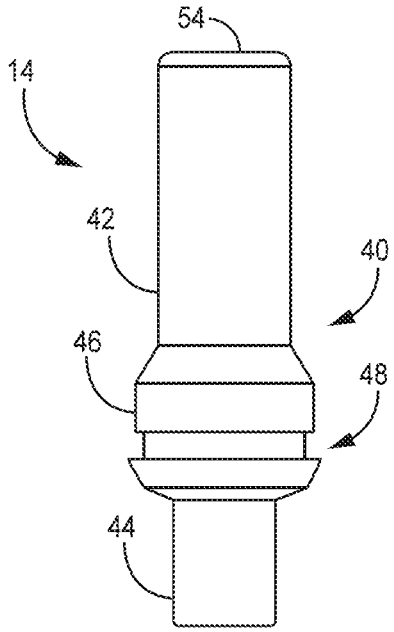
FIG. 2C is a front view of the pump bulb of FIG. 2A, according to one embodiment.
Figure 2D:
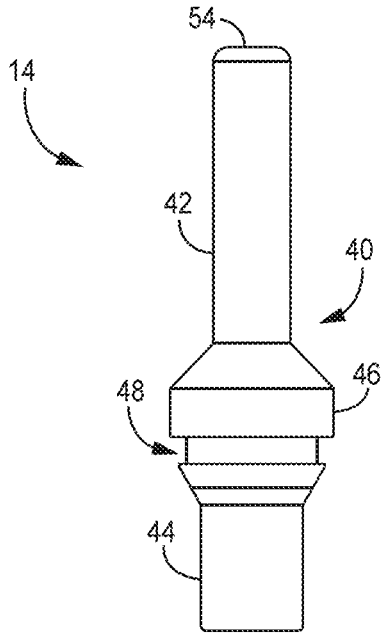
FIG. 2D is a side view of the pump bulb of FIG. 2A, according to one embodiment.
Figure 2E:
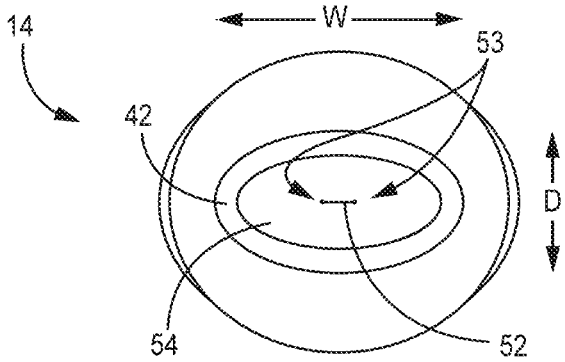
FIG. 2E is a top view of the pump bulb of FIG. 2A, according to one embodiment.
Figure 3A:
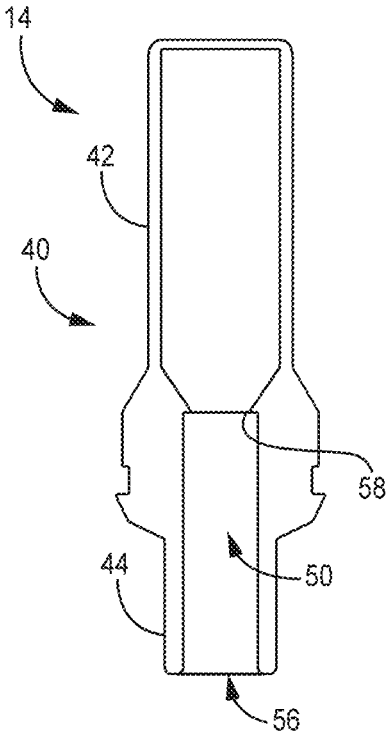
FIG. 3A is a cross-sectional front view of the pump bulb of FIG. 2A, according to one embodiment.
Figure 3B:
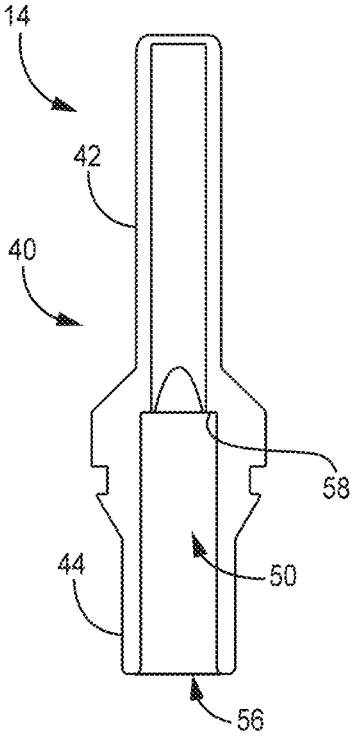
FIG. 3B is a cross-sectional side view of the pump bulb of FIG. 2A, according to one embodiment.
Figure 3C:
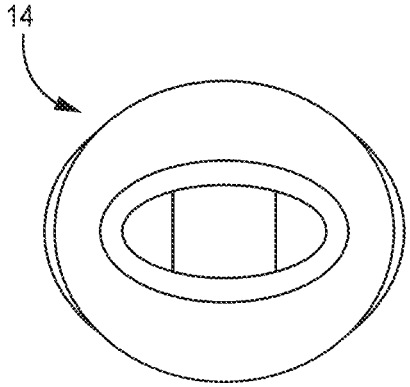
FIG. 3C is a cross-sectional top view of the pump bulb of FIG. 2A, according to one embodiment.

In one embodiment, the mouthpiece 42 has an oval shape as best shown in FIGS. 2A, 2E, and 3C such that the mouthpiece 42 fits well within the mouth of a user. As such, as best shown in FIG. 2A, the mouthpiece 42 has a width W that is greater than its depth D. The width W of the mouthpiece 42 is depicted in FIGS. 2C and 3A, while the depth of the mouthpiece 42 is depicted in FIGS. 2D and 3B. In one embodiment, the width W is 9 mm and the depth D is 6 mm. Alternatively, the width W can vary from about 1 mm to about 45 mm, or, in a further alternative, the width W can vary from about 3 mm to about 20 mm. According to yet another alternative, the width W can vary from about 10 mm to about 17 mm. In further alternatives, the depth D can vary from about 0.2 mm to about 40 mm, or, in another alternative, the depth D can vary from about 1 mm to about 15 mm. According to yet another alternative, the depth D can vary from about 6 mm to about 13 mm. Further, the dimensions of both the width W and the depth D can also be any size between those ranges. In certain embodiments, the exact width and depth dimensions of the mouthpiece can be adjusted to best fit the mouth of the user. Alternatively, the mouthpiece 42 can have any known cross-sectional shape that facilitates positioning of the mouthpiece 42 in a user's mouth.

Figure 12A:
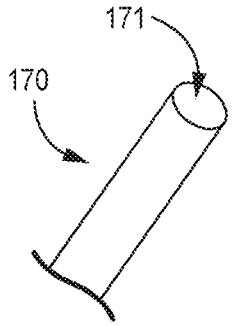
FIGS. 12A-12D depict side views of various mouthpiece shapes, according to certain embodiments.
Figure 12B:
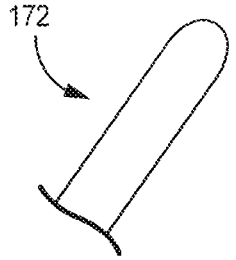
Figure 12C:
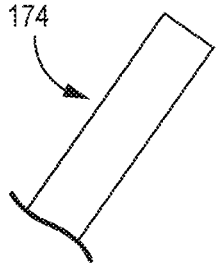
Figure 12D:
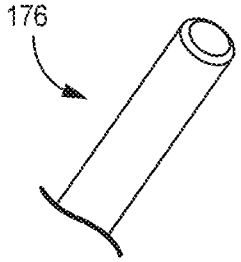

As best shown in FIGS. 12A-12D, any mouthpiece in any bulb implementation herein can have any number of configurations. For example, the mouthpiece 170 can have a cylindrical shape as shown in FIG. 12A with an opening 171 defined in the distal tip. Alternatively, the mouthpiece 172 can have a cylindrical shape with a rounded bulb at the distal tip as shown in FIG. 12B. In a further alternative as shown in FIG. 12C, the mouthpiece 174 has a cylindrical shape with a flat end. In addition, FIG. 12D depicts a mouthpiece 176 with an inverted end.

In addition to the cross-sectional shape, the pump bulb 14 is structured such that the length of the mouthpiece 42 also fits well within the mouth of the user. More specifically, the central body 46 has a diameter that is greater than the diameter of the mouthpiece 42 such that the proximal end of the mouthpiece 42 is clearly defined by the protrusion of the body 46. As such, the central body 46 serves as a barrier, thereby preventing the user from inserting the bulb 14 any further into the user's mouth. In other words, the barrier of the central body 46 at the proximal end of the mouthpiece 42 defines the length of the mouthpiece 42 to be inserted into the user's mouth. Alternatively, instead of a collar or protrusion, any bulb embodiment herein (including bulb 14) can have a central body that is an indentation or recess such that the central body allows for the user to position her lips or teeth within the indentation, thereby serving a similar purpose of establishing the length of the mouthpiece 42 during use. In further alternatives with respect to any embodiment herein, the central body has an outer diameter that is substantially similar to or the same as the outer diameter of at least one of the proximal extension and the mouthpiece such that there is no protrusion or indentation along the length of the bulb.

According to one embodiment, the mouthpiece 42 has a length from the tip 54 to the collar 46 of about 35 mm. Alternatively, the length can vary from about 7 mm to about 65 mm, or, in a further alternative, can vary from about 15 mm to about 50 mm. According to yet another alternative, the length can vary from about 25 mm to about 45 mm. Further, the length dimensions can also be any length between those ranges. In certain embodiments, the length of the mouthpiece can be varied to best fit the mouth of the user.

In certain implementations, the width and length of the mouthpiece 42 are sized to provide sufficient surface area for the user to deform (such as compression, for example) during use thereof, as will be described in additional detail below. Further, according to various embodiments, the volume of the interior lumen 50 is sized to limit the amount of water that will be urged into the user's mouth at one time, thereby increasing the number of actions required by the user on the mouthpiece 42 to drink a quantity of water (and thereby increasing the exercise by the user).

The mouthpiece 42, along with all other mouthpiece embodiments disclosed or contemplated herein, has at least one opening 52 defined therein that provides fluidic communication between the exterior of the mouthpiece 42 and the interior lumen 50 defined therein. According to one embodiment as best shown in FIGS. 2A and 2E, the at least one opening 52 is a single slit 52 defined in the tip 54 of the mouthpiece 42. In certain specific implementations, the slit 52 can have a strain relief opening 53 defined at each end of the slit 52, such that the relief openings 53 help to reduce the stress at each end of the slit 52 and thereby prevent or reduce the amount of tearing of the slit 52 at each end during use. Alternatively, any known mechanism or structure for reducing stress on the opening 52 can be incorporated into the opening 52. The slit 52, according to the embodiment as shown, is disposed on the tip 54 such that the length of the slit 52 is horizontal to the width W of the mouthpiece 42. Because the user is likely to insert the mouthpiece 42 into her mouth such that the width W thereof is horizontal to the user's lips, any force applied by the user's lips is applied in a direction transverse to the length of the slit 52. As such, the force does not cause the slit 52 to open and allow liquid to readily flow through. In contrast, if the length of the slit 52 were parallel to the force applied by the user's lips or teeth, the user could bite down or compress the mouthpiece 42 and cause the slit 52 to open and allow liquid to pass through without correct performance of the target exercise. The benefits of the slit 52 in operation of the mouthpiece 42 will be discussed in additional detail below.

Alternatively, the at least one opening 52 in the various embodiments herein can be one or more openings of any number of known shapes or configurations. That is, any number of other opening configurations, shapes, or structures can have the same characteristics and benefits as the slit 52 described above. For example, multiple small circular openings can also provide a substantial restriction to flow until a predetermined amount of negative pressure is applied by the user, as will be described in detail below. Further, other opening configurations can also produce the same effect.

Figure 2F:
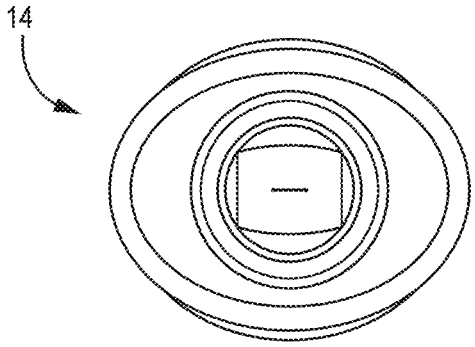
FIG. 2F is a bottom view of the pump bulb of FIG. 2A, according to one embodiment.
Figure 2G:
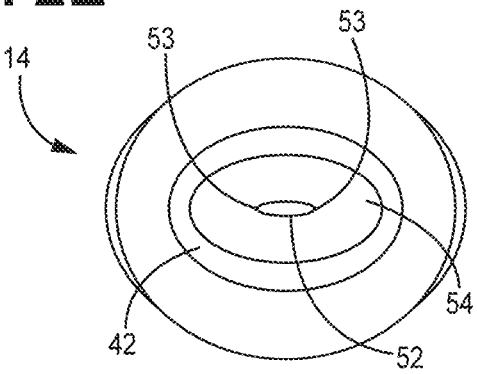
FIG. 2G is a top view of the unrestricted configuration of FIG. 2E, according to one embodiment.

The proximal extension 44 is substantially circular according to certain embodiments and has a circular opening 56 as best shown in FIGS. 2B and 2F that is in fluidic communication with the interior lumen 50. The circular shape of the extension 44 and the circular shape of the opening 56 facilitate attachment of the proximal extension 44 to an elongate tube (such as the tube 12 discussed above) or any tube embodiment disclosed or contemplated herein with a substantially circular shaped cross-section.

As mentioned above, certain implementations of the collar 46 have a channel 48 defined around the outer perimeter of the collar 46 such that the channel 48 can serve as an attachment component or mechanism. More specifically, in those embodiments in which the pump bulb 14 is incorporated into a container (such as the container 10 discussed in detail above), the opening (such as opening 20 above) in the container through which the bulb 14 is positioned can have a lip (not shown) around an inner surface of the opening. Thus, when the bulb 14 is urged into position within the opening in the container (such as opening 20 as discussed above) to attach the bulb 14 thereto, the channel 48 is positioned within the opening such that the lip (not shown) is disposed within the channel 48, thereby providing a sealed coupling of the collar 46 to the lid or other component in which the opening (such as opening 20) is defined. Alternatively, in those embodiments in which any bulb embodiment is not used with a container, then the bulb need not have a channel.

As best shown in FIGS. 3A and 3B, the interior lumen 50 can have a lip 58 defined within the collar 46 that serves as a straw advancement barrier. That is, the lip 58 has a narrower diameter than the interior lumen 50 along the length of the proximal extension 44. Further, the lip 58 is configured to have a narrower diameter than the elongate tube or straw (such as tube 12) that is inserted into the interior lumen 50 of the proximal extension 44 such that the straw can only be inserted up to the lip 58. As such, the bulb 14 is configured to prevent the straw from being inserted into the mouthpiece 42, thereby eliminating any risk that the straw negatively influences the structural characteristics of the mouthpiece 42.

In one embodiment, the pump bulb 14 (and any other pump bulb disclosed or contemplated herein) is a single unitary component made of a silicone that is safe for the user. Alternatively, the bulb 14 (or any other bulb as disclosed or contemplated herein) can be made from any other known material(s) that is pliable and can be compressed with the tongue. This can include sponge-like material, braided material, mesh material, fabric-like material, rubber material, plastic material, and/or any other known material that is safe to place in one's mouth and that satisfies the mechanical properties required. The material, in certain implementations, can have a surface texture that is smooth and or/soft so that use may be comfortable for the user and/or the device may lessen abrasion on the tongue and mouth. The material can be easily cleanable and/or dishwasher safe.

According to one implementation, the material of the bulb 14 has a hardness of 30A durometer. Alternatively, the hardness of the bulb 14 material can range from about OA durometer to about 100A durometer, or, in a further alternative, can range from about 15A to about 75A. According to yet another alternative, the hardness can vary from about 25A to about 45A. Further, the hardness can be any amount of hardness between those ranges. As discussed in additional detail below, the hardness of the bulb 14 material can be modified to change the resistance of the bulb 14 to a user's efforts to urge liquid from the interior lumen 50 into the mouth of the user, thereby tailoring the resistance to a desired level for the benefit of the user.

In accordance with certain embodiments, the walls of the mouthpiece 42 have a thickness of about 1.5 mm along the length of the mouthpiece 42 (the sides of the mouthpiece 42) and about 1 mm thickness at the tip 54. Alternatively, the thickness of the side walls and the tip of the mouthpiece 42 can vary from about 0.1 mm to about 10 mm, or, in a further alternative, can vary from about 0.3 mm to about 5 mm. According to yet another alternative, the thickness can vary from about 0.5 mm to about 2 mm. In these implementations, the thickness of the tip 54 wall is less than the thickness of the side walls of the mouthpiece 42 in order to ensure that the resistance of the mouthpiece 42 feels uniform at the tip 54 and along the side walls of the mouthpiece 42.

The various characteristics of the mouthpiece 42 including the wall thickness, hardness, shape, and the size of the opening 52 (such as length of the slit 52) are the factors that influence the resistance of the mouthpiece 42 and the flow of liquid through the opening 52 when the user manipulates the mouthpiece 42 during use, as will be discussed in further detail below. Thus, any one or more of these factors can be altered to adjust the resistance of the mouthpiece 42 and/or the flow of liquid to the desired level for the specific user.

Figure 4A:
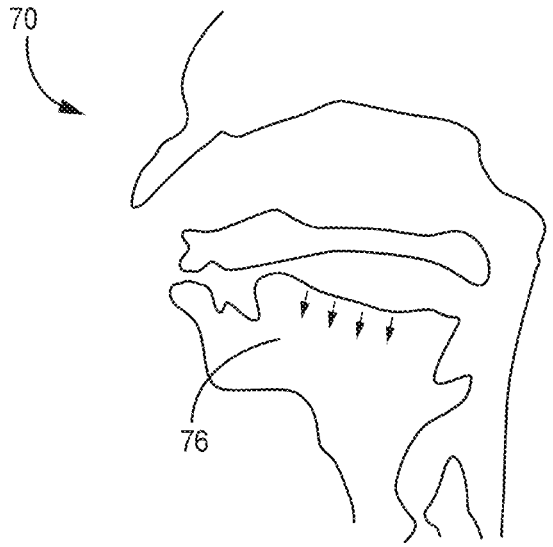
FIG. 4A is a schematic view of a mouth exercise, according to one embodiment.
Figure 4B:
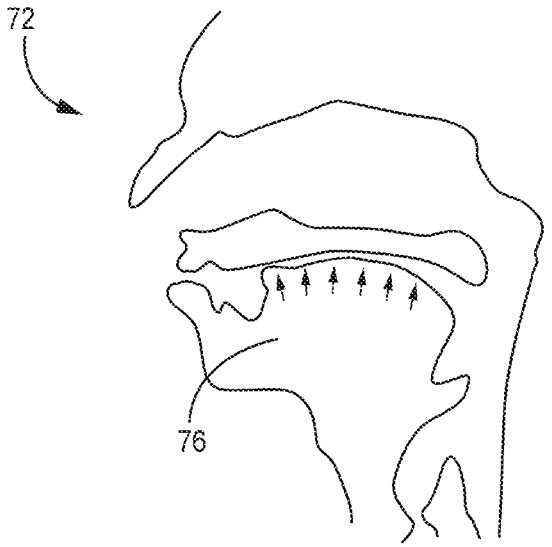
FIG. 4B is a schematic view of another mouth exercise, according to one embodiment.
Figure 4C:
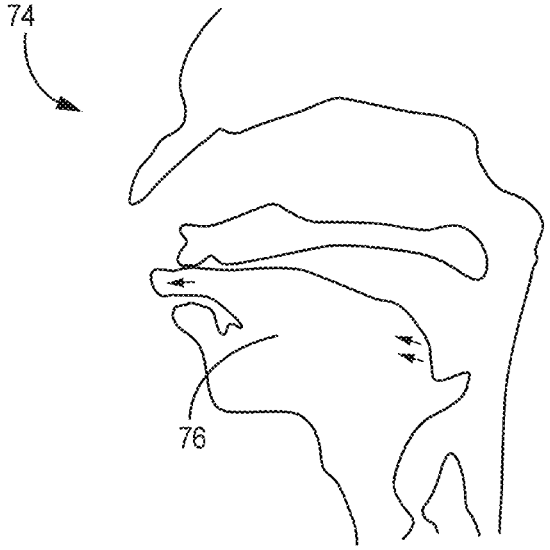
FIG. 4C is a schematic view of another mouth exercise, according to one embodiment.

The therapies provided by any of the various devices disclosed or contemplated herein can strengthen the muscles of the tongue, especially the genioglossus. As best shown in FIGS. 4A-4C, according to certain embodiments, there are 4 main exercise movements that can be performed using the device embodiments herein, including the tongue suction exercise 70 (as shown in FIG. 4A), the tongue press exercise 72 (as shown in FIG. 4B), the tongue push exercise 74 (as shown in FIG. 4C), and the swallow exercise (not shown), which relates to repeated swallows as exercise. As will be discussed in further detail herein, the various device embodiments herein can be used by a user to perform at least one or any combination of these exercises. Further, as also explained herein, certain device implementations enhance the ability of the user to perform one or more of these exercises.

The tongue suction exercise as shown in FIG. 4A involves an attempt to mimic the bolus formation of a normal swallow. That is, the tongue 76 creates a bolus by extending towards the bottom of the mouth. This creates a negative pressure, and the edges of the tongue 76 are bowed upward creating a bowl or trough. This targets use of the middle genioglossus muscle, and, without being limited by theory, it may also target the hyoglossus, palatoglossus, and transverse muscles of the tongue 76. Other muscles it may target are the styloglossus and vertical muscles of the tongue 76.

The tongue press exercise as shown in FIG. 4B is a motion that mimics when the tongue 76 presses upwards during the swallow to push the bolus of food or liquid into the pharynx. The tip of the tongue 76 is pressed up against the hard palate behind the front top teeth and the back of the tongue 76 is pressed up in a wave-like motion pushing the bolus towards the back of the throat. Without being limited by theory, it appears that the superior longitudinal muscle is activated along with the genioglossus, hyoglossus, and palatoglossus muscles.

The tongue push exercise as shown in FIG. 4C is a movement of the tongue 76 in which the tongue 76 is stuck outside of the mouth in a straight motion. This exercise activates the inferior genioglossus and, if the tongue 76 is pointed, it also activates the transverse tongue muscle. This motion may also have movements to the left, right, up, or down when sticking out to increase range of motion and strengthen additional muscles and/or target specific muscles.

In one embodiment, the exercises that can be performed by a user using any of the device embodiments disclosed herein can combine the Tongue Suction and Tongue Press exercises. These exercises are natural motions used in the action of swallowing, they are balanced against each and activate different sets of muscles, and they activate most or all the muscles of the tongue. Beyond strengthening the muscles of the tongue and throat, this therapy method can also improve swallowing ability. This therapy method can also promote proper tongue resting position by exercising the tongue in ways that put the tongue near this position and strengthen muscles that may make the tongue more naturally go into this position. This therapy can benefit snorers, persons with sleep apnea, dysphagia patients, elderly who have trouble swallowing, people who want to tighten up muscles to look more beautiful, people who want to correct their tongue resting position, and anybody who wants to improve the strength and endurance of their tongue.

Alternatively, any combination of the three therapy exercises described above can be performed using any of the device embodiments disclosed or contemplated herein.

The methods of performing the various exercises herein using any of the various device embodiments have a number of benefits for the user. For example, rather than expecting a user to schedule time and make the effort to perform the exercises using any of the known exercise devices available, the use of the various device implementations disclosed or contemplated herein ties the therapy to the biologically driven action of drinking water. Further, the therapy is portable and can be performed anywhere with discretion and convenience, it is easy to track (by counting the number of bottles of liquid consumed, for example), it promotes hydration, and it provides the desired physical improvements, including reduced snoring, reduced tiredness, improved nasal breathing, improved tongue placement, a toned jawline, reduced sleeping issues, and improved energy. Other benefits are discussed elsewhere herein.

Additional therapeutic benefits may result from the various exercises herein, in accordance with certain alternative implementations. For example, one such therapeutic benefit may be nasal breathing during therapy. More specifically, nasal breathing activates the muscles of the palate and is promoted in myofunctional therapy. In addition, according to another example, the swallow exercise (incorporating an increased number of swallows) activates the muscles of the soft palate.

Among the benefits of the various device embodiments herein and the methods of using the same, the daily drinking of water using any of the devices herein results in the user no longer being forced to think about the therapy or determine when to perform the exercises. Instead, the exercises are a part of the normal daily routine of drinking water. As will be described in detail elsewhere herein, many of the various device implementations herein can be used with a water bottle, straw, cup, lid, or any other known drinking device that the various embodiments herein can be combined with to be incorporated into the daily routine of drinking water by the user. In further alternatives, liquids other than water, semi-liquids, or soft solids can be used in the various devices herein.

Returning now to the pump bulb 14 of FIGS. 2A-3C in view of the exercises described above, according to some implementations, the combination of the mouthpiece 42 structural characteristics and the slit 52 in the tip 54 thereof is configured to enhance the benefits of those exercises. More specifically, the tip 54 wall thickness (as discussed above) along with the hardness and the slit 52 length— determines the amount of force required to open the slit 52 during use, thereby influencing the effort that must be made by the user to urge liquid therethrough (assuming, of course, that the mouthpiece 42 is positioned in the user's mouth correctly). For example, during the tongue suction exercise, the slit 52 establishes a threshold value of force that must be applied by the user via tongue suction in order to get the liquid to pass through the slit 52. This threshold value ensures that the user must use sufficient force via the tongue suction exercise to provide the desired benefits of the exercise to the user. Further, as the desired additional force/pressure is applied to the mouthpiece 42 via the tongue suction action and the tongue suction exercise is performed correctly, the combination of the slit 52 and the pliability of the tip 54 material allows the slit 52 to expand into a bigger hole, thereby allowing greater flow of the liquid. This expansion of the slit 52 and increased liquid flow allows for the user to receive sufficient liquid to hydrate the user/satisfy the user's thirst. The resulting change in flow, if charted as a graph, would reveal an S-shaped curve. As such, the structure of the tip 54 and slit 52 provides two configurations: (1) an initial, reduced flow configuration in which the slit 52 restricts flow and requires additional force applied by the user, thereby encouraging the user to optimize her exercises (thereby enhancing the benefits thereof), and (2) a subsequent, enhanced flow configuration in which the slit 52 opens up as a result of the additional force applied by the user, thereby allowing sufficient flow to satisfy the user's thirst. That is, the structure creates an "aha" effect for the user in that she knows she is performing the exercise correctly and applying sufficient force because she begins to get a greater flow of liquid into her mouth with less relative work.

As discussed above, various other opening configurations can produce the same beneficial effect as the slit 52 described above. For example, multiple small circular openings can also provide a substantial restriction to flow until a predetermined amount of negative pressure is applied by the user. Further, other opening configurations can also produce the same effect. In contrast, if the opening were a larger and/or less restrictive opening, rather than a slit 52 or other restrictive opening, the additional effect of the increased flow of liquid after the minimum threshold is cleared would not occur, and the user would not receive the indication of correct action as described above. Instead, a user could sip at lower or higher pressures with a linear change in flow with an increase in pressure.

Figure 5A:
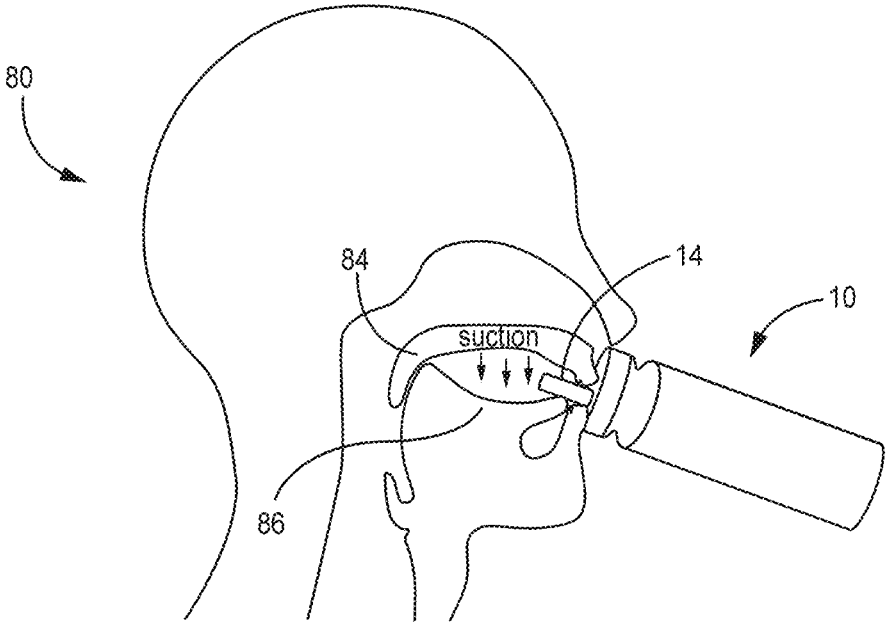
FIG. 5A is a schematic view of a user performing the suction exercise using an exercise device, according to one embodiment.
Figure 5B:
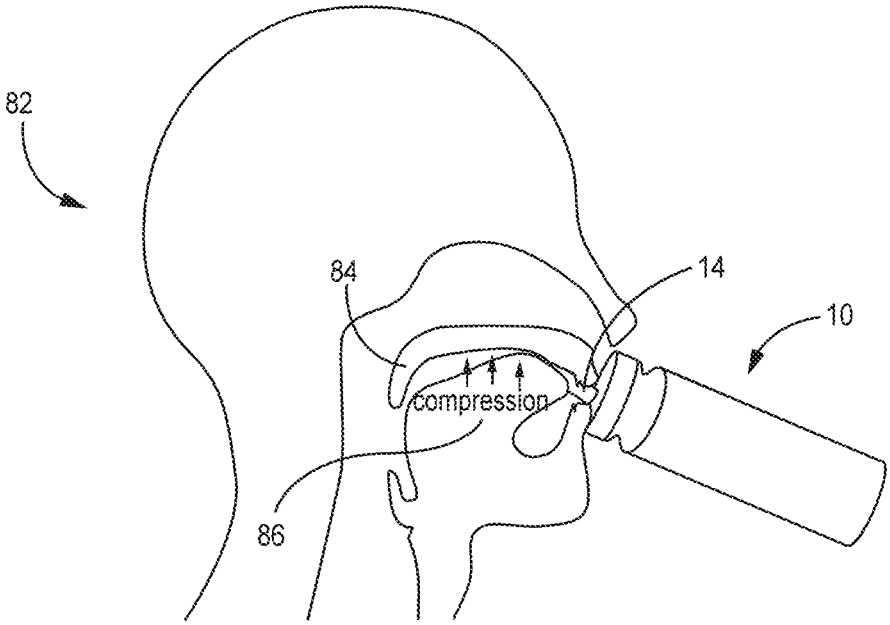
FIG. 5B is a schematic view of a user performing the tongue press exercise using an exercise device, according to one embodiment.

In use, as shown in FIGS. 5A and 5B, a pump bulb (such as the bulb 14 described above) can be used to perform, for example, the tongue suction exercise 80 as shown in FIG. 5A, the tongue press exercise 82 as shown in FIG. 5B, or both. Further, additional exercises, such as the tongue push exercise can also be performed. In the specific embodiment depicted in FIGS. 5A and 5B, the exercises are performed using the pump bulb 14 incorporated into the liquid container 10 described in detail above. Alternatively, the exercises can be performed using any device embodiment disclosed or contemplated herein.

As shown in FIG. 5A, the tongue suction exercise as described above is performed using the container device 10 with the bulb 14. In the exercise, the tongue 86 is extended toward the bottom of the mouth, creating space between the tongue 86 and the hard palate 84 and thereby creating negative pressure within the user's mouth such that a suction is applied to the bulb 14.

Further, as shown in FIG. 5B, the tongue press exercise as described above is performed using the device 10 and bulb 14. In the exercise, the tongue 86 is pressed upwards towards the hard palate 84 to mimic the swallowing action of urging food or liquid into the pharynx. More specifically, the tip of the tongue 86 is urged into contact with the hard palate 84 behind the front top teeth and the back of the tongue 86 is urged upward in a wave-like motion such that, if food/liquid were present, the tongue 86 would urge the food/liquid towards the back of the throat.

Figure 6:
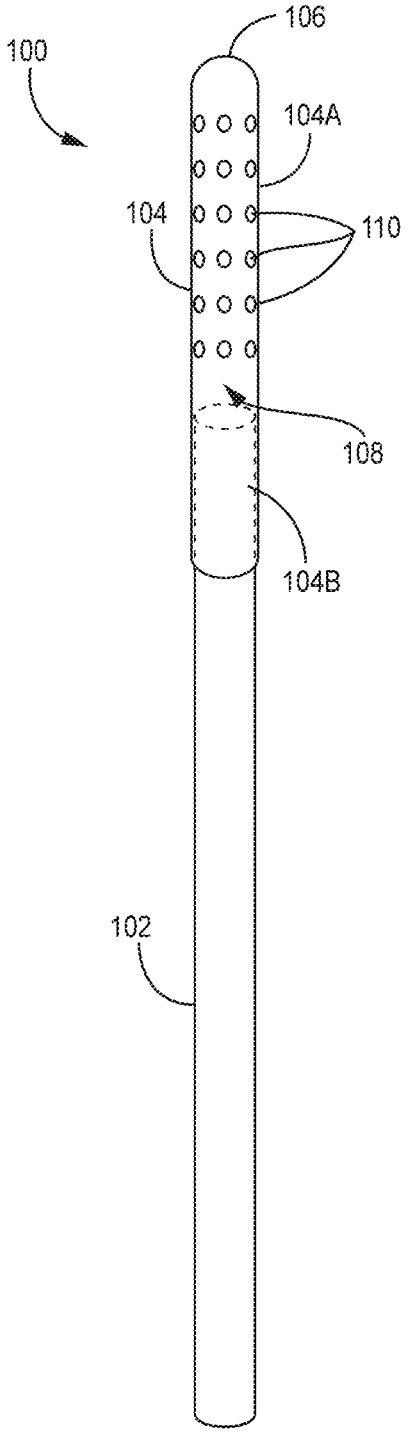
FIG. 6 is a side view of another exercise device, according to a further embodiment.
Figure 7A:
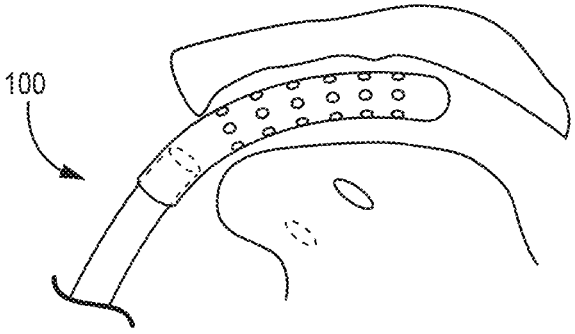
FIG. 7A is a schematic view of a user inserting the exercise device of FIG. 6 in the user's mouth, according to one embodiment.
Figure 7B:
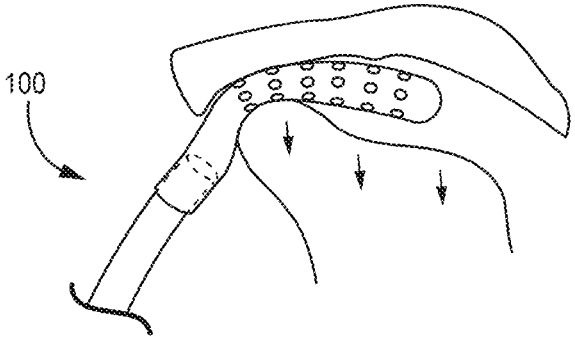
FIG. 7B is a schematic view of a user performing the suction exercise using the exercise device of FIG. 6, according to one embodiment.
Figure 7C:
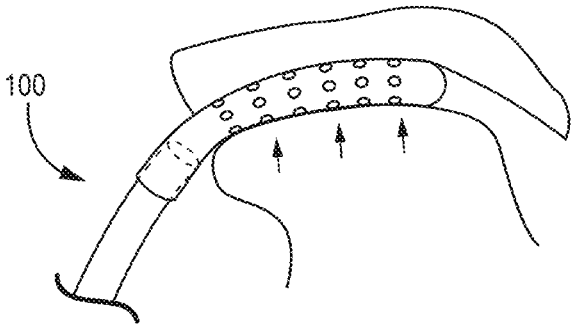
FIG. 7C is a schematic view of a user performing the tongue press exercise using the exercise device of FIG. 6, according to one embodiment.

Another exemplary embodiment of an exercise device 100 is shown in FIGS. 6-7C. In this implementation, the device 100 is an elongate tubular body (or "straw") 102 with a pump bulb (also referred to as a "perforated bulb" or "perforated mouthpiece") 104 disposed at the distal end thereof. According to one embodiment, the bulb 104 is attached to the distal end of the tube 102. Alternatively, the bulb 104 is integral with the tube 102 such that the bulb 104 and tube 102 constitute a single component. The bulb 104 has a mouthpiece section 104A distal of the tube 102 and a proximal section 104B where the bulb 104 overlaps with or couples with the tube 102. As with the bulb 14 described above, the proximal section 104B is less flexible and does not have the same structural characteristics as the mouthpiece 104A. The bulb 104 has a cylindrical shape with a rounded tip 106. Further, the bulb 104 in this exemplary implementation has a lumen 108 defined therein and has multiple openings (or "perforations") 110 defined in the bulb 104 walls that provide fluidic access between the lumen 108 and the exterior of the bulb 104. Alternatively, the bulb 104 can have one opening, two openings, or any number of openings. In the specific embodiment shown, the openings 110 are round holes or perforations 110. Alternatively, the openings 110 can have any known shape (including, for example, a slit shape).

Figure 13A:
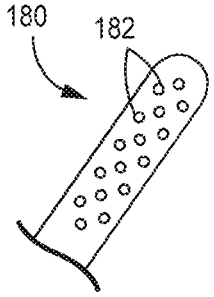
FIGS. 13A-13F depict side views of various distal opening configurations, according to certain embodiments.
Figure 13B:
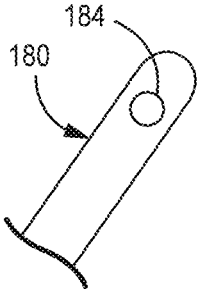
Figure 13C:
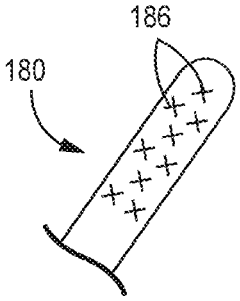
Figure 13D:
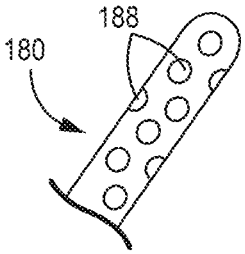
Figure 13E:
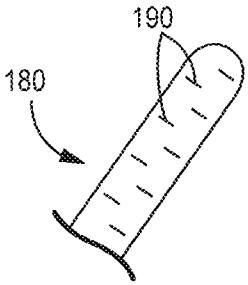
Figure 13F:
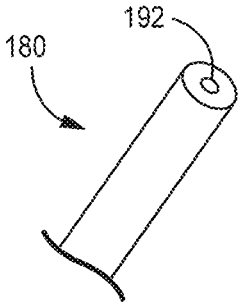

Generally, any of the various mouthpiece embodiments disclosed or contemplated herein can have any opening configuration, shape or number as described above. Thus, the opening can be numerous openings, three openings, two openings, a single opening, or any number of openings. For example, in FIG. 13A, the mouthpiece 170 has multiple circular openings 172. Alternatively, as shown in FIG. 13B, the mouthpiece 170 has a single opening 174. In a further embodiment, as shown in FIG. 13C, the mouthpiece 170 has multiple X-shaped openings 176. According to another alternative as shown in FIG. 13D, the mouthpiece 170 has multiple larger openings 178 (larger than the openings 172 of FIG. 13A). Further, in accordance with a further implementation, as shown in FIG. 13E, the mouthpiece 170 has multiple slits 180. Yet another embodiment as shown in FIG. 13F is a mouthpiece 170 with a single opening 182 defined in the distal tip of the mouthpiece 170. Alternatively, the opening(s) can have any other geometric shape that allows passage of fluid. The opening diameter, shape, and/or configuration may be designed to close during the tongue suction exercise and open during the tongue press exercise. Alternatively, the opening(s) can be open throughout the tongue press exercise and the tongue suction exercise, or, in a further alternative, can open and close throughout. In accordance with various embodiments, the opening(s) can be in different positions on the mouthpiece. The various configurations can also help to reduce water squirting into the back of the user's throat and thereby causing discomfort.

Except as stated herein, the bulb 104 operates in the same fashion as the bulb 14 embodiment discussed in detail above or any other bulb embodiment herein, such that any one or more of the three exercises discussed above can be performed using this device 100. Further, any of the additional/optional features described above with respect to other embodiments can be incorporated into this device 100 where feasible. Unlike the device 10 discussed above, the instant exercise device 100 is solely a tube 102 and bulb 104, which means that the device 100 can be inserted into and used with any liquid container.

In use as best shown in FIGS. 7A-7C, the user can place the bulb 104 in the user's mouth (as best shown in FIG. 7A) and perform either the tongue suction exercise (as shown in FIG. 7B) or the tongue press exercise (as shown in FIG. 7C). Further, the user can also perform the tongue push exercise as discussed elsewhere. The various exercises can be performed using the bulb 104 in substantially the same manner as described above, so the performance of those exercises will not be described in additional detail here.

Figure 8:
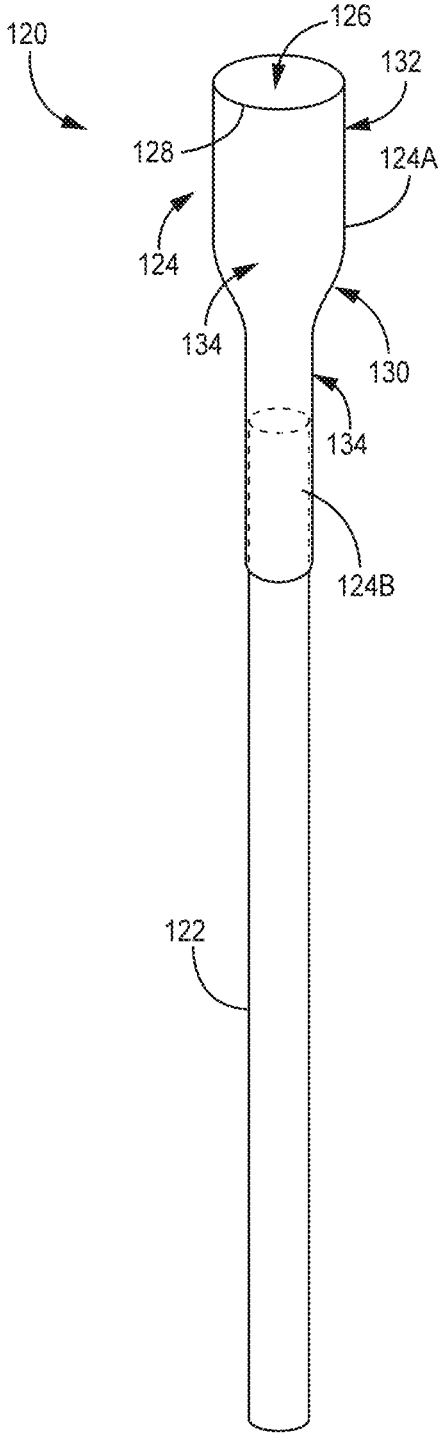
FIG. 8 is a perspective view of another exercise device, according to a further embodiment.
Figure 9A:
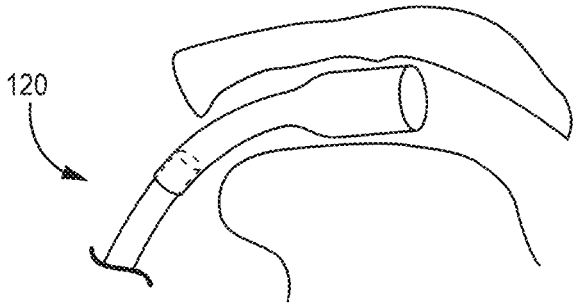
FIG. 9A is a schematic view of a user inserting the exercise device of FIG. 8 in the user's mouth, according to one embodiment.
Figure 9B:
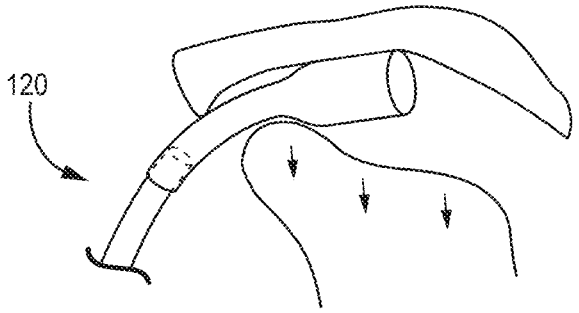
FIG. 9B is a schematic view of a user performing the suction exercise using the exercise device of FIG. 8, according to one embodiment.
Figure 9C:
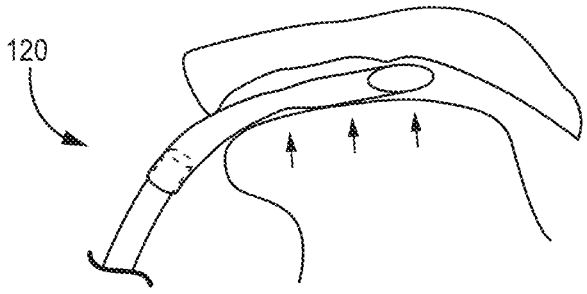
FIG. 9C is a schematic view of a user performing the tongue press exercise using the exercise device of FIG. 8, according to one embodiment.

A further exercise device 120 implementation is depicted in FIGS. 8-9C, in which the device 120 is an elongate tube (or straw) 122 with a pump bulb 124 disposed at the distal end of the tube 122, wherein the bulb has an opening 126 defined in the distal end 128 thereof. According to one embodiment, the bulb 124 is attached to the distal end of the tube 122. Alternatively, the bulb 124 is integral with the tube 122 such that the bulb 124 and tube 122 constitute a single component. The bulb 124 has a mouthpiece section 124A distal of the tube 122 and a proximal section 124B where the bulb 124 overlaps with or couples with the tube 122. As with the bulbs 14, 104 described above, the proximal section 124B is less flexible and does not have the same structural characteristics as the mouthpiece 124A. The bulb 124 has a generally cylindrical shape with a conical section 130, a distal cylinder section 132, and a proximal cylindrical section 134 with a smaller diameter than the distal cylindrical section 132. Further, the bulb 124 has a lumen 134 defined therein that is in fluidic communication with the distal opening 126 such that the opening 126 that provide fluidic access between the lumen 134 and the exterior of the bulb 124. Except as stated herein, the bulb 124 operates in the same fashion as the bulb 14, 104 embodiments discussed in detail above or any other bulb embodiment herein, such that any one or more of the three exercises discussed above can be performed using this device 120. Further, any of the additional/optional features described above with respect to other embodiments can be incorporated into this device 120 where feasible. Like the device 100 discussed above, the instant exercise device 120 is solely a tube 122 and bulb 124, which means that the device 120 can be inserted into and used with any liquid container.

In use as best shown in FIGS. 9A-9C, the user can place the bulb 124 in the user's mouth (as best shown in FIG. 9A) and perform either the tongue suction exercise (as shown in FIG. 9B) or the tongue press exercise (as shown in FIG. 9C). Further, the user can also perform the tongue push exercise as discussed elsewhere. The various exercises can be performed using the bulb 124 in substantially the same manner as described above, so the performance of those exercises will not be described in additional detail here.

As mentioned above, any of the various pump bulb features and/or components described herein with respect to any of the various device embodiments can be incorporated into any of the other bulb implementations. Further, any of the pump bulb embodiments herein can be incorporated into or used with any of the container implementations disclosed or contemplated herein.

Figure 10A:
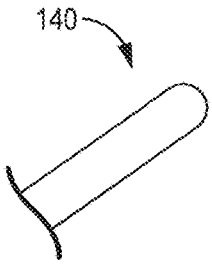
FIGS. 10A-10D depict side views of various pump bulb shapes, according to certain embodiments.
Figure 10B:
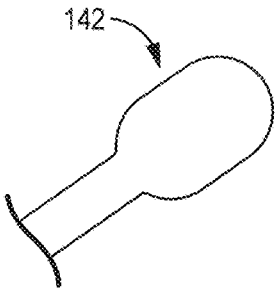
Figure 10C:
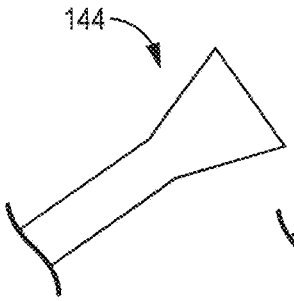
Figure 10D:
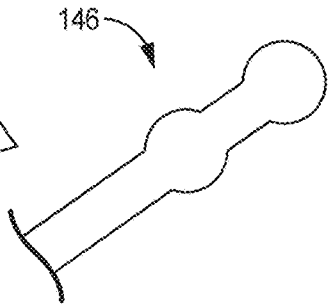

The various pump bulb embodiments herein can have any shape that fits easily into the mouth. A few of the non-limiting, exemplary shapes for the bulb embodiments are depicted in FIGS. 10A-10D. More specifically, FIG. 10A depicts a cylindrical bulb shape 140, while FIG. 10B depicts a substantially spherical bulb shape 142. Further, FIG. 10C depicts a trapezoidal bulb shape 144, while FIG. 10D shows a bulb 146 shaped with two spherical sections. Alternatively, any bulb can have any known shape, and in further alternatives can have two or more sections of any known shape.

Figure 11A:
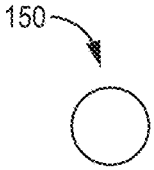
FIGS. 11A-11I depict top cross-sectional view of various pump bulb cross-sectional shapes, according to certain embodiments.
Figure 11B:
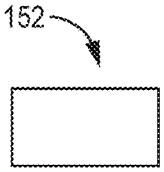
Figure 11C:
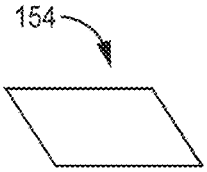
Figure 11D:
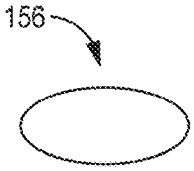
Figure 11E:
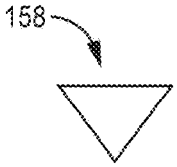
Figure 11F:
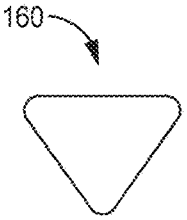
Figure 11G:
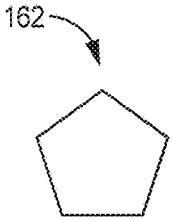
Figure 11H:
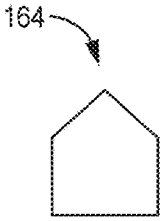
Figure 11I:
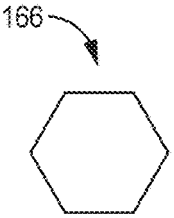

Various alternative implementations can also have any known cross-sectional shape that can be incorporated into any pump bulb embodiment. For example, various bulb embodiments can have a circular shape 150 (as shown in FIG. 11A), a rectangular shape 152 (as shown in FIG. 11B), a trapezoidal shape 154 (as shown in FIG. 11C), an ovular shape 156 (as shown in FIG. 11D), a triangular shape 158 (as shown in FIG. 11E), a triangular shape with rounded corners 160 (as shown in FIG. 11F), a pentagonal shape 162 (as shown in FIG. 11G), a different pentagonal shape 164 (as shown in FIG. 11H), or a hexagonal shape 166 (as shown in FIG. 11I). Further, the distal end in any implementation herein can be rounded, flat, inverted, open, or have any other known configuration. Further, in various alternative embodiments, the pump bulb may get narrower in some areas and/or wider in others. Further, in certain exemplary implementations, the pump bulb may be designed to look like a nozzle to make it look discrete.

As also discussed above, in the various bulb embodiments disclosed or contemplated herein, there can be multiple predetermined variations of hardness, thickness, volume, and/or size of the bulb to allow for different therapy levels, therapy repetitions, and/or differently sized mouths of different users. Any of the various bulb implementations may distribute the force applied by the user required to compress the bulb in different ways to provide targeted therapy by having different thicknesses of material, different shapes, having fill materials, being honeycomb-like, be hollow, having ridged structures, and/or having multiple bulb structures.

Further, any of the embodiments can also have features, mechanisms, or be structurally configured for guiding proper movement of the mouth during the tongue press exercise by having the bulb compress in a predetermined way based on the structural features of the bulb. In accordance with certain implementations, instructions can be provided to the user to ensure proper performance of the exercise. Alternatively, no instructions are needed.

In other embodiments with respect to any bulb implementation disclosed or contemplated herein, the bulb characteristics can be tailored to enhance the benefits of the tongue press exercise. That is, in certain embodiments, the elastic properties of the bulb material can cause the bulb to reform to its original shape after it is compressed. When the bulb is returning to its original shape, the mouthpiece opening(s) are sealed such that a negative pressure is created within the bulb, thereby causing the interior lumen of the bulb to fill with liquid via the opening in the proximal extension. Once the bulb contains the desired amount of liquid, the seal of the mouthpiece opening(s) can be overcome when the bulb is compressed by the user, thereby causing the mouthpiece material to deform such that internal pressure increases to the point of overcoming the bulb opening(s) seal.

Alternatively, other bulb embodiments are configured to be filled with liquid by using gravity such that the bulb (and, in certain implementations, the container attached thereto) is tilted, thereby causing the bulb to fill with liquid such that a user can then use the mouthpiece to perform the tongue press exercise to drink the water. In a further alternative, any system embodiment herein can have a container to which the bulb is attached that is configured to create a positive pressure. In various embodiments, this positive pressure can be created by, for example, decreasing the volume of the container in some manner (such as by such as by compressing the volume of the container) and/or by adding air into the container.

In certain embodiments, as best shown in FIGS. 14A and 14B, the interior lumen of any bulb embodiment herein such as the exemplary bulb 200 as shown can have at least one section or length therein defining a narrow diameter 204 to restrict airflow therethrough. The narrow diameter section (or "flow restriction section" or "neck") 204 results in a small opening or lumen 206 defined at any location along the length of the lumen 202 within the bulb 200. That is, the narrow section 204 can be defined within any one or more of the proximal extension, the collar, and/or the mouthpiece of any bulb implementation herein. In one embodiment, the small opening 206 can have a diameter of about 0.9 mm. Alternatively, the small opening 206 can have a diameter ranging from about 0.1 mm to about 2 mm. In further embodiments, as shown in FIGS. 14C and 14D, the narrow section 204 can be two or more small openings 210 that have the same effect as the single small opening 206.

In a further alternative, instead of a narrow section, any bulb implementation herein can have a restrictive valve—such as a one-way valve or check valve—that requires force to open it in each flow direction. As with the narrow section, any such valve can be disposed anywhere along the length of the bulb lumen. For example, in one specific embodiment, the bulb 200 can have a one-way valve 220 disposed within the lumen 202 as shown in FIGS. 14E and 14F. In additional alternatives, the one-way valve can be any of the valve configurations shown in FIGS. 15A-15C, including the ball valve 222 in FIG. 15A, the flap valve 224 in FIG. 15B, and the diaphragm check valve 226 in FIG. 15C. Further, any known valve configuration can be used in the various implementations herein.

Figure 17A:
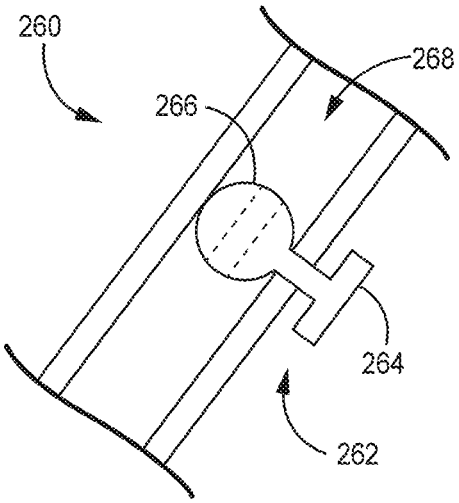
FIGS. 17A and 17B depict cross-sectional side views of additional flow restriction mechanisms, according to certain embodiments.
Figure 17B:
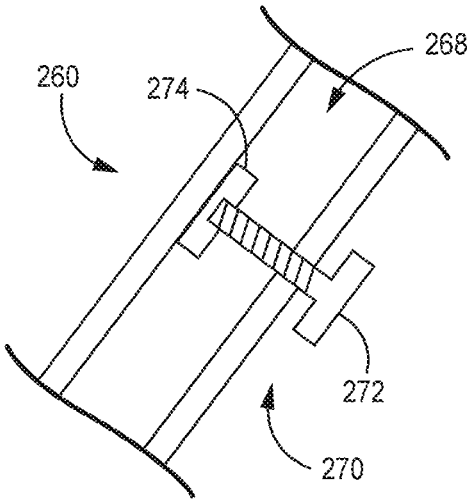

According to yet another alternative, the flow restriction can be an adjustable valve. For example, in one embodiment as shown in FIG. 17A, the bulb 260 has a control valve 262 having a handle 264 that can be turned or otherwise manipulated to adjust the position of the valve body 266 within the lumen 268, thereby adjusting the size of the opening within the lumen 268. Alternatively, according to another implementation as shown in FIG. 17B, the bulb 260 has a screw valve 270 having a handle 272 that can be turned or otherwise manipulated to adjust the position of the valve body 274, thereby adjusting the size of the opening within the lumen 268.

The lumen restriction—whether configured as a narrow section or a valve—can increase the pressure required to be applied by the user during the tongue suction exercise in order to increase flow of liquid therethrough. Further, the restriction can reduce backflow of liquid during the tongue press exercise. Alternatively, the restriction can be a restrictive hole defined in the lid in any of the container embodiments herein. That is, instead of a restriction within the bulb, an additional opening is defined in the container lid such that air entering the container is restricted by that opening, thereby resulting in increased negative pressure as liquid is urged out of the container (through the bulb) at a faster rate than air is allowed in through the opening.

Figure 16A:
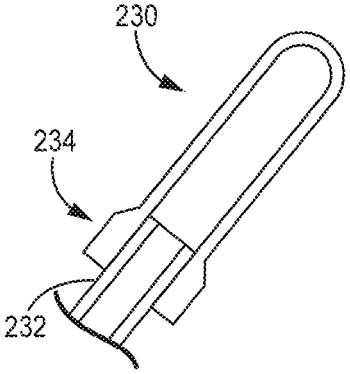
FIGS. 16A-16H depict side cross-sectional views of various connection structures for the connection of a bulb to an elongate tube, according to certain embodiments.
Figure 16B:
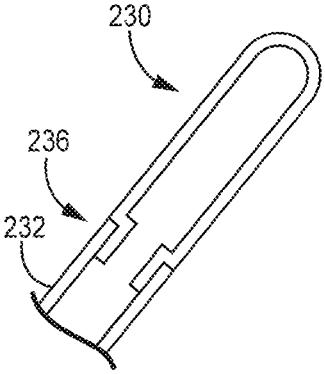
Figure 16C:
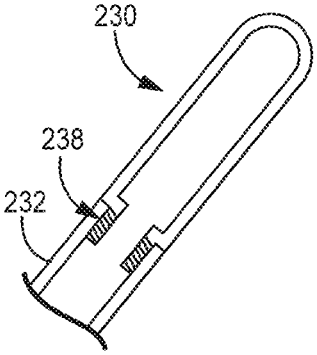
Figure 16D:
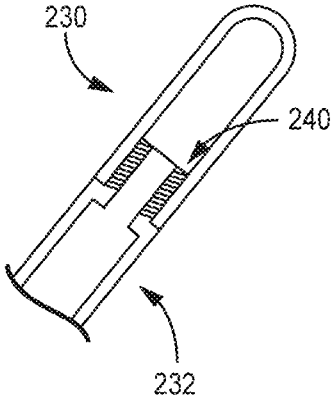
Figure 16E:
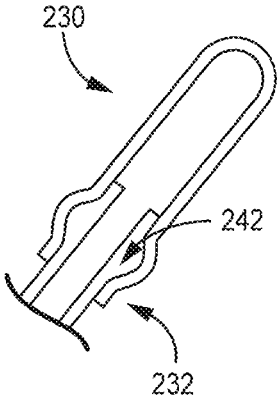
Figure 16F:
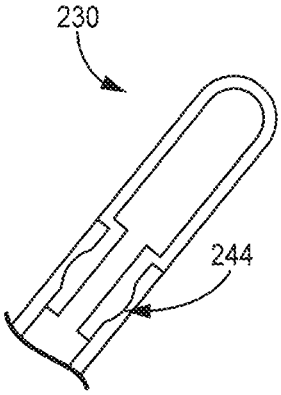
Figure 16G:
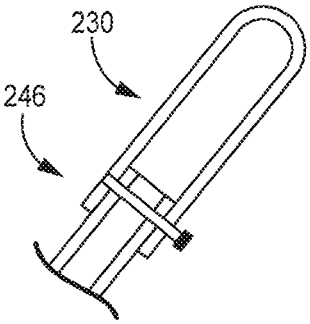
Figure 16H:
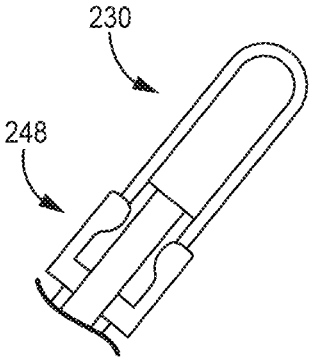

As discussed above, any bulb herein may be integral with or attached to a tube and/or straw. Further, any bulb herein also be attached to a liquid container or the lid of that container. In various embodiments, the bulb is removable from the elongate tube to allow easier cleaning and/or replacement with a different bulb. Various attachment methods and mechanisms can be used to attach the bulb to the elongate tube. For example, in one implementation, the bulb 230 is attached to the elongate tube 232 via a compression fit 234 as shown in FIG. 16A. Alternatively, as shown in FIG. 16B, the bulb 230 is attached to the tube 232 via an internal compression fit 236. In a further alternative, the bulb 230 is attached to the tube 232 via an internal threaded connection 238, as depicted in FIG. 16C. Further, as shown in FIG. 16D, the connection can be an external threaded connection 240. According to yet another alternative as shown in FIG. 16E, the connection can be an external divot connection 242, or, in a further alternative, the connection can be an internal divot connection 244, as shown in FIG. 16F. Another implementation is depicted in FIG. 16G, which shows a tied latch connection 246, while FIG. 16H depicts another latch connection 248, according to a further embodiment. Alternatively, any known attachment method or mechanism can be used. Further, the various bulbs disclosed or contemplated herein may have a ledge, stopper, marking, groove, or some other known mechanism that controls how far the bulb is positioned on the tube. In a further alternative, O-rings can be used to help make a seal between the tube and pump bulb.

Based on the various bulb parameters as discussed above—including wall thickness, material hardness, shape, size of opening in narrow section, mouthpiece opening size/configuration, etc.—any pump bulb according to any of the various embodiments herein may be designed to be used throughout the day in a low-intensity, high-frequency manner. That is, the amount of force required to compress the bulb and suction up the liquid may be a low intensity value to allow for drinking normal amounts of liquid (such as water, for example) throughout the day, including, for example, but not limited to, 16.9 oz, 20 oz, 24 oz, 1 L, 1.5L.

Alternatively, the pump bulb—in accordance with any of the embodiments disclosed or contemplated herein—may be designed for high intensity, low frequency use. That is, the user may drink smaller portions of water throughout the day to get adequate level of therapy and then use alternative methods to drink water. There may be multiple levels of workout intensity that can be adjusted or changed by the user. Such adjustments can include changing out different pump bulbs with different compression forces by varying wall thickness, shape, material hardness, opening sizes, or any other parameter as discussed herein. According to certain implementations, each bulb can be customized for the user and/or there may be bulbs with predetermined parameters for non-tailored use.

In certain implementations, any device embodiment herein can be configured to provide the option to drink water normally if the user no longer wants to do the exercise. For example, in one embodiment, the device allows for the bulb to be removable. Further, in certain embodiments, any device herein can provide a place to place or attach the removed bulb on the bottle or lid or in a separate carrying case. Alternatively, the mouthpiece and/or bulb may be able to telescope into and out of a space defined within the bottle or lid. In a further alternative, the device may have a separate opening (separate from the bulb) on the lid or elsewhere that is open or able to be opened for use to drink water without using the bulb. According to another embodiment, the mouthpiece or bulb may rotate into the lid. Further, the pump bulb may be able to be turned inside out and go into lid and/or elongate tube.

Figure 18:
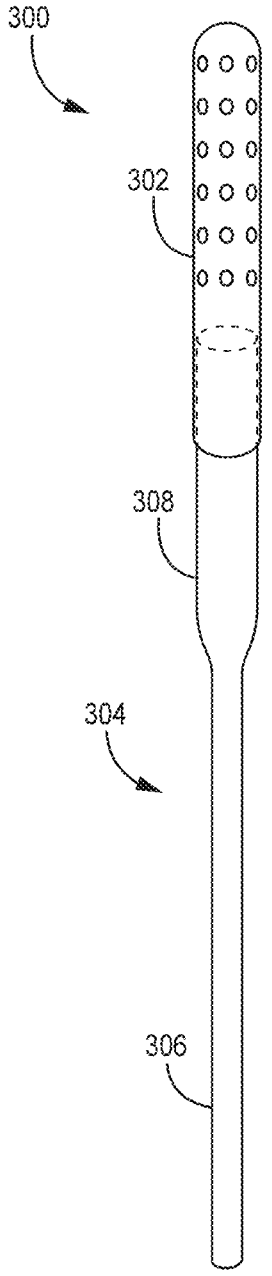
FIG. 18 is a perspective view of another exercise device, according to a further embodiment.

In a further implementation, instead of controlling the level of resistance via the bulb, the elongate tube is configured to create the desired level of resistance for the user's exercises. For example, as shown in FIG. 18, the device 300 has a bulb 302 that is removably attached to an elongate tube (or "straw") 304 in a fashion similar to other embodiments as described elsewhere herein. In this specific embodiment, the media within the device 300 can be air, instead of a liquid. Further, any other device embodiment disclosed or contemplated herein can be used with any form of fluid either liquid or gas. Alternatively, the bulb 302 can be integral with the straw 304 such that the bulb 302 and straw 304 are one component. The straw 304 has two inner diameters: a first, reduced inner diameter 306 and a second, larger inner diameter 308. As such, the length of the straw 304 having the reduced inner diameter 306 is a restricted air passage 306 that provides a resistant force to the user trying to urge air (or, alternatively, liquid) into her mouth during use. The bulb 302 can be configured in a fashion similar to any other bulb embodiment or feature thereof as described according to any embodiment disclosed or contemplated herein. In a further implementation in which a gas (such as air) is used, the bulb 302 can have no openings defined therein.

Alternatively, the resistant force created in the elongate tube can be in the form of an opposing force, such as a balloon, a valve, a membrane, a turning wheel, or any other known mechanism or feature for providing a desired level of resistance. For example, the opposing force can be a balloon (not shown) that is inflated to create resistance. Alternatively, the resistance can be created by a combination of the bulb configuration and the elongate tube configuration.

Figure 19A:
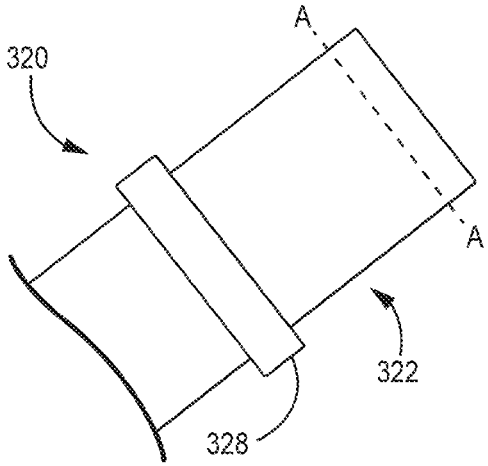
FIG. 19A depicts a side view of a mouthpiece, according to one embodiment.
Figure 19B:
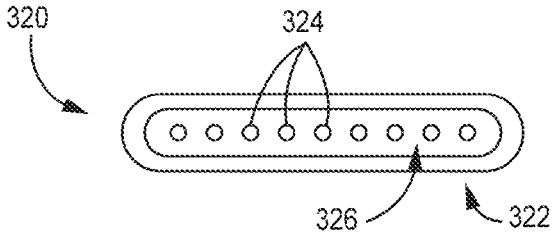
FIG. 19B depicts a top view of the mouthpiece of FIG. 19A, according to one embodiment.
Figure 19C:
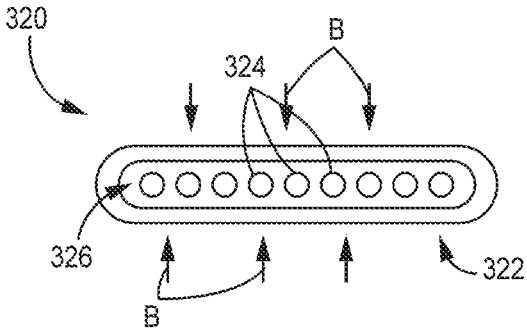
FIG. 19C depicts another top view of the mouthpiece of FIG. 19A, according to one embodiment.
Figure 20:
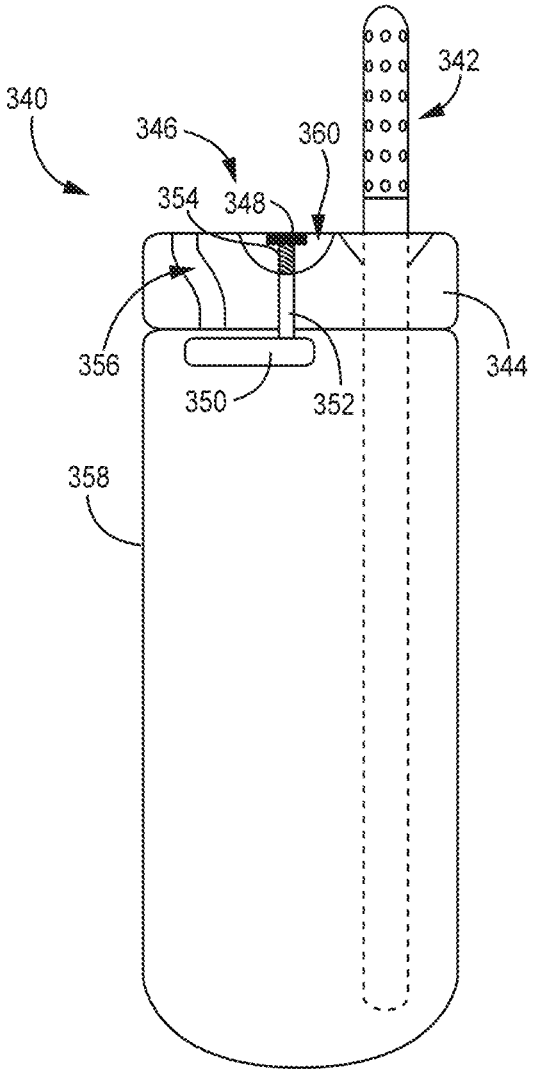
FIG. 20 is a side view of another exercise device, according to a further embodiment.

In another embodiment as best shown in FIGS. 19A-19C, a bulb 320 is provided that can provide fluid access via compression. More specifically, the bulb 320 has a mouthpiece 322 with openings 324 defined within the bulb 320 that can be opened by applying a compressive force to the mouthpiece 322. In the specific exemplary implementation depicted, the distal end of the mouthpiece 322 has a large opening 326 defined therein, with the plurality of openings 324 disposed within the large opening 326 such that the openings 324 are disposed at a distance proximally of the distal end. More specifically, the line A in FIG. 19A depicts the cross-sectional aspect of the mouthpiece 322 that is captured in FIGS. 19B and 19C. Alternatively, the openings 324 can be disposed at the distal end of the mouthpiece 322. The openings 324 are configured to open or increase in diameter upon application of force. Thus, as represented by the arrows B, which reflect the force being applied, the mouthpiece 322 can be compressed by the user such as by the tip of the tongue and/or the back of the tongue to cause the openings 324 to open or widen to allow liquid to flow therethrough. In certain implementations, there may be multiple portions or sections along the length of the mouthpiece 322 to compress to open the fluid path therein. One portion may be designed to be compressed with teeth, which may allow for proper positioning of the nozzle and/or prevention of using the jaw in the tongue compression portion. According to some embodiments, the bulb 320 can have a raised portion and/or teeth guard ("protrusion") 328 (as shown in FIG. 19A) on the mouthpiece 328 to guide proper placement in mouth. Gravity or other mechanisms or methods may allow for the liquid to flow into the user's mouth once the mouthpiece 322 has been compressed as required.

In accordance with another embodiment, a system 340 can be provided that combines a bulb 342 with a container lid 344 having a valve 346 for use in the tongue push exercise. The lid 344 is removably attached to a container 358. Alternatively, the lid 344 can have any configuration and can be coupled to any type of container. The bulb 342 can be any bulb embodiment as disclosed or contemplated herein and can have any of the additional or alternative features as described herein as well. The valve 346 has a push button 348, a valve body 350, a rod 352 coupling the button 348 to the body 350, and a tension spring 354 coupled to the push button 348 such that the spring 354 urges the button 348 and the valve body 350 to their closed position. The valve body 350 is disposed on the underside of the lid 344 in communication with an opening 356 defined in the lid 344. When the valve 346 is in the closed position, the valve body 350 is disposed against the underside of the lid 344 such that the body 350 seals the opening 356 closed. In contrast, when the button 348 is urged toward the lid 344 such that the valve 346 is urged into the open position, the valve body 350 is urged away from the underside of the lid 344 such that the opening 356 is in fluidic communication with the interior of the container 358, thereby allow fluid to flow through the opening 356. When force is removed from the button 348 (that is, the user stops applying force via her tongue), the tension spring 354 urges the button 348 back to its resting position (the closed position). The valve button 348 in this specific embodiment is disposed within a recess 360 defined in the lid 344 such that the button 348 can be urged toward the lid 344 within the recess 360. In use, according to one embodiment, the user can use the tongue push exercise to push "down" (toward the lid 344) on the button 348 such that liquid can flow through the opening 356. Further, the user can also use the bulb 342 to perform the other exercises as described elsewhere herein. Alternatively, other known mechanisms can be used in place of the exemplary valve 346 depicted, such as a windup mechanism or any other known mechanism or component. Regardless of the specific mechanism/component, the user's tongue will have to repeatably push the button (using the tongue push exercise) to open the valve to drink the liquid.

Figure 21A:
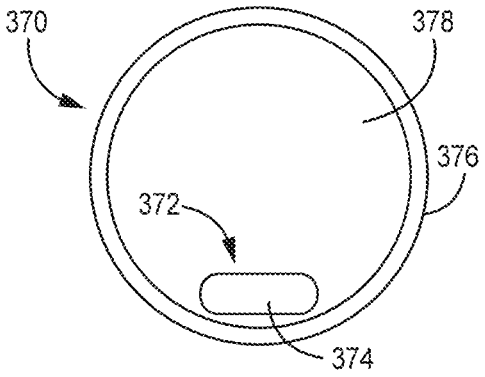
FIG. 21A depicts a top view of another exercise device, according to another embodiment.
Figure 21B:
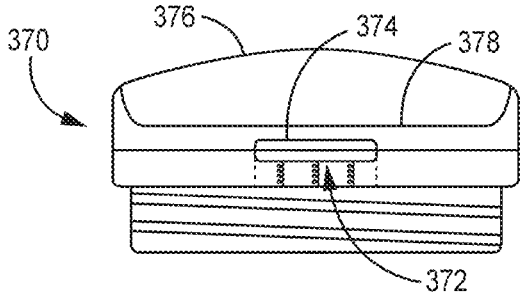
FIG. 21B depicts a side view of the exercise device of FIG. 20A, according to one embodiment.
Figure 21C:
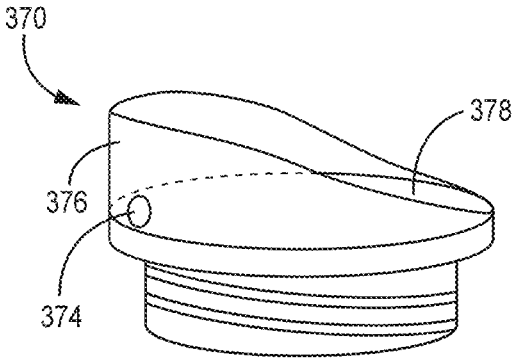
FIG. 21C depicts a perspective view of the exercise device of FIG. 20A, according to one embodiment.

Another embodiment of a lid 370 with a tongue push valve 372 is depicted in FIGS. 21A-21C. In this exemplary implementation, the valve 372 is positioned such that the push button 374 is "hidden" or positioned discretely on the lid 370 such that the user's tongue push exercises cannot be seen by individuals in close proximity with the user during the exercises. In other words, the push button 374 is positioned or the lid 370 is configured such that others cannot see what the user is doing with her tongue. In this specific implementation, the lid 370 has a lip (or "ridge") 376 that extends outward from the outer perimeter of the lid 370 around at least a portion of the perimeter to block the visual access to the top surface 367 of the lid 370 during use. While the full valve 372 with the valve body and other components is not shown, it is understood that the valve 372 has the same or substantially similar components to the valve 346 described above, except as described herein. Alternatively, the valve 372 can be any known valve having any known mechanisms for operation.

Figure 22A:
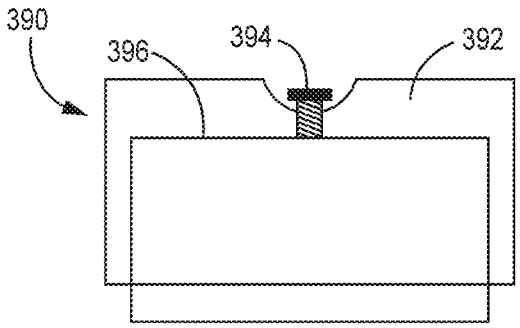
FIG. 22A depicts a side view of another exercise device, according to a further embodiment.
Figure 22B:
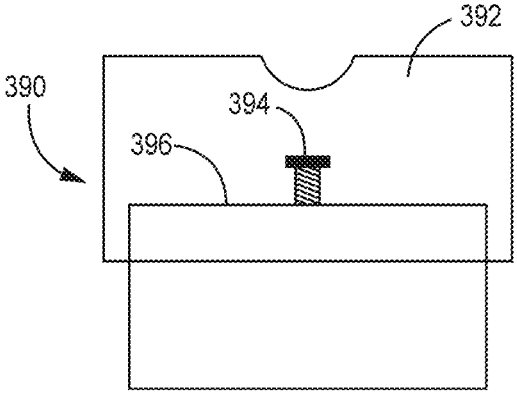
FIG. 22B depicts another side view of the exercise device of FIG. 22A, according to one embodiment.

In further alternative tongue push valve embodiments as best shown in FIGS. 22A-24, the valve can have a mechanism or feature for varying the required force of the tongue push or the distance required to push the button in with the tongue. For example, as best shown in FIGS. 22A-22B according to one exemplary embodiment, the lid 390 can have an adjustable lip 392 that can be extended between a retracted position as shown in FIG. 22A and an extended position as shown in FIG. 22B or any position therebetween. The specific mechanism can be any known mechanism that causes the lip 392 to telescope or rotate between the retracted and extended positions. As such, the adjustable positioning of the lip 392 adjusts the distance from the lid lip 392 to the button 394, which is disposed on or near the top surface 396 of the lid 390. This adjustable feature of the lip 392 allows for adjustment of the distance that the user must extend her tongue in order to successfully depress the button 394.

Figure 23A:
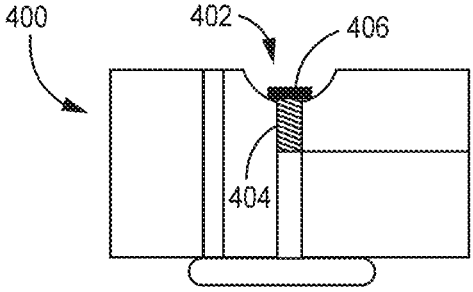
FIG. 23A depicts a side view of another exercise device, according to a further embodiment.
Figure 23B:
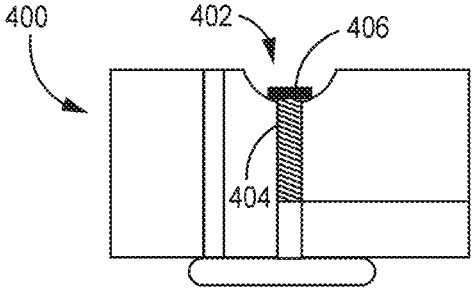
FIG. 23B depicts another side view of the exercise device of FIG. 23A, according to one embodiment.

According to another alternative implementation, one tongue push valve embodiment as shown in FIGS. 23A and 23B has an adjustable force component. More specifically, a lid 400 is provided having a valve 402 with an adjustable tension spring 404 such that the amount of force required to urge the valve 402 open can be adjusted. As shown in the figures, the tension spring 404 can be adjusted between a high tension configuration as shown in FIG. 23A and a low tension configuration as shown in FIG. 23B, and any position therebetween. As such, a user can adjust the spring 404 and thus the amount of force required to urge the button 406 a set distance.

Figure 24:
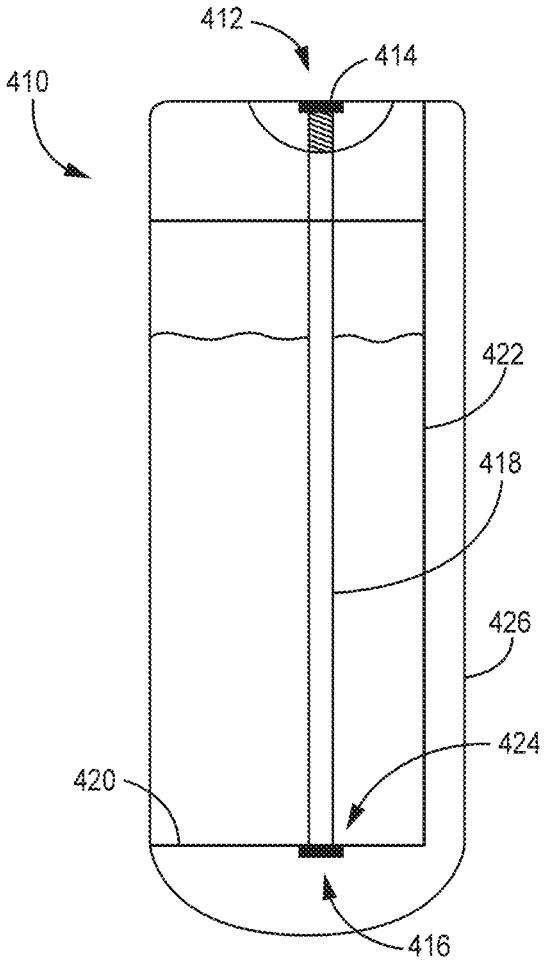
FIG. 24 depicts a side view of another exercise device, according to a further embodiment.

Yet another system implementation for tongue push exercises is depicted in FIG. 24, which shows a container 410 having a valve 412 with a push button 414, a valve body 416, and an elongate rod 418 coupling the button 414 to the body 416. In this embodiment, the valve body 416 is disposed next to an exterior surface of a bottom wall 420 of the internal container 422 (such that the rod 418 extends through an interior of the internal container 422 as shown) such that the valve body 416 is in adjustable communication with an opening 424 in the bottom wall 420. In use, when the button 414 is pushed in by the user's tongue, the valve body 416 is urged away from the bottom wall 420, thereby allowing liquid from the external container 426 to enter the internal container 422 through the opening 424. When the button 414 is released, the valve body 416 returns to its position in contact with the bottom wall 420, thereby closing the opening 424. The liquid in the internal container 422 can then be drunk by the user and the process repeated as desired.

As discussed elsewhere in this application, the various different components and/or features of the various embodiments disclosed or contemplated herein can be incorporated into any other embodiment and/or combined with any other components and/or features.

Although the various embodiments have been described with reference to preferred implementations, persons skilled in the art will recognize that changes may be made in form and detail without departing from the spirit and scope thereof.

What is claimed is:

1. A method of oropharyngeal exercise, comprising:

placing an oropharyngeal exercise device into a user's mouth, the oropharyngeal exercise device comprising:

(i) a mouthpiece sized and shaped to be insertable into the user's mouth;

(ii) a lumen defined within the mouthpiece; and (iii) a flow restriction structure associated with the mouthpiece;

applying a first amount of negative pressure to the lumen via the mouthpiece as necessitated by the flow restriction structure to create a first flow rate of a fluid through the lumen; and applying a second amount of negative pressure to the lumen via the mouthpiece as necessitated by the flow restriction structure to create a second flow rate of the fluid through the lumen, wherein the second amount of negative pressure is greater than the first amount of negative pressure.

2. The method of claim 1, wherein the applying the first amount of negative pressure and the applying the second amount of negative pressure constitute a tongue exercise.

3. The method of claim 1, wherein the second flow rate is greater than the first flow rate.

4. The method of claim 3, wherein the second flow rate results in an increased amount of the fluid flowing into the user's mouth relative to the first flow rate.

5. The method of claim 4, wherein the increased amount of the fluid flowing into the user's mouth indicates to the user that the user is performing the method of oropharyngeal exercise correctly.

6. The method of claim 1, wherein the oropharyngeal exercise device further comprises a device body, wherein the mouthpiece comprises a portion of the device body.

7. The method of claim 1, wherein the flow restriction structure comprises at least one distal opening defined in the mouthpiece and in fluidic communication with the lumen.

8. The method of claim 7, wherein the at least one distal opening is a slit defined in a distal end of the mouthpiece.

9. The method of claim 8, wherein a length of the slit is parallel with a cross-sectional width of the mouthpiece.

10. A method of oropharyngeal exercise, comprising:

placing an oropharyngeal exercise device into a user's mouth, the oropharyngeal exercise device comprising:

(i) a bulb body comprising a mouthpiece sized and shaped to be insertable into the user's mouth;

(ii) a lumen defined within the bulb body;

(iii) a proximal opening in fluidic communication with the lumen, wherein the proximal opening allows fluid to flow into the lumen;

(iv) a flow restriction structure associated with the bulb body; and (v) at least one distal opening defined in the mouthpiece and in fluidic communication with the lumen, wherein the flow restriction structure can be the at least one distal opening;

applying a first amount of negative pressure to the lumen via the mouthpiece as necessitated by the flow restriction structure to create a first flow rate of the fluid through the lumen; and applying a second amount of negative pressure to the lumen via the mouthpiece as necessitated by the flow restriction structure to create a second flow rate of the fluid through the lumen, wherein the second amount of negative pressure is greater than the first amount of negative pressure.

11. The method of claim 10, wherein the applying the first amount of negative pressure and the applying the second amount of negative pressure constitute a tongue exercise.

12. The method of claim 10, wherein the second flow rate is greater than the first flow rate.

13. The method of claim 12, wherein the second flow rate results in an increased amount of the fluid flowing into the user's mouth.

14. The method of claim 13, wherein the increased amount of the fluid flowing into the user's mouth indicates to the user that the user is performing the method of oropharyngeal exercise correctly.

15. The method of claim 10, wherein the at least one distal opening is a slit defined in a distal end of the mouthpiece.

16. The method of claim 15, wherein a length of the slit is parallel with a cross-sectional width of the mouthpiece.

17. A method of oropharyngeal exercise, comprising:

inserting an oropharyngeal exercise device into a user's mouth, the oropharyngeal exercise device comprising:

(i) a bulb body comprising a mouthpiece sized and shaped to be insertable into the user's mouth;

(ii) a lumen defined within the bulb body;

(iii) a proximal opening in fluidic communication with the lumen, wherein the proximal opening allows fluid to flow into the lumen;

(iv) a flow restriction structure associated with the bulb body; and (v) at least one distal opening defined in the mouthpiece and in fluidic communication with the lumen, wherein the flow restriction structure can be the at least one distal opening;

positioning the oropharyngeal exercise device into the user's mouth to complete the oropharyngeal exercise;

applying a first amount of negative pressure to the lumen via the mouthpiece as necessitated by the flow restriction structure to create a first flow rate of the fluid through the lumen; and applying a second amount of negative pressure to the lumen via the mouthpiece as necessitated by the flow restriction structure to create a second flow rate of the fluid through the lumen, wherein the second amount of negative pressure is greater than the first amount of negative pressure and the second flow rate is greater than the first flow rate, and wherein the second flow rate results in an increased amount of the fluid flowing into the user's mouth.

18. The method of claim 17, wherein the applying the first amount of negative pressure and the applying the second amount of negative pressure constitute a tongue exercise.

19. The method of claim 17, wherein the increased amount of the fluid flowing into the user's mouth indicates to the user that the user is performing the method of oropharyngeal exercise correctly.

20. The method of claim 17, wherein the at least one distal opening is a slit defined in a distal end of the mouthpiece, wherein a length of the slit is parallel with a cross-sectional width of the mouthpiece.

* * * * *